US009096407B2

(12) United States Patent
Gamo

(10) Patent No.: US 9,096,407 B2
(45) Date of Patent: Aug. 4, 2015

(54) SHEET PROCESSING APPARATUS AND IMAGE FORMING APPARATUS

(71) Applicant: CANON KABUSHIKI KAISHA, Tokyo (JP)

(72) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/937,634

(22) Filed: Jul. 9, 2013

(65) Prior Publication Data

US 2014/0015187 A1 Jan. 16, 2014

(30) Foreign Application Priority Data

Jul. 11, 2012 (JP) ..... 2012-155356

(51) Int. Cl.
*B65H 37/04* (2006.01)
*B31F 1/07* (2006.01)
*B65H 5/02* (2006.01)

(52) U.S. Cl.
CPC *B65H 37/04* (2013.01); *B31F 1/07* (2013.01); *B65H 5/02* (2013.01); *B31F 2201/07* (2013.01); *B31F 2201/0712* (2013.01); *B31F 2201/0758* (2013.01); *B31F 2201/0771* (2013.01); *B65H 2301/5126* (2013.01); *B65H 2801/27* (2013.01)

(58) Field of Classification Search
CPC ..... B65H 5/001; B65H 5/02; B65H 37/04; B65H 2801/27; B31F 1/07; B31F 2201/07; B31F 2201/0771; B31F 2201/0758; B31F 2201/0712
USPC ..... 270/58.07, 58.08, 58.11
See application file for complete search history.

(56) References Cited

U.S. PATENT DOCUMENTS

| | | | | |
|---|---|---|---|---|
| 5,709,376 | A * | 1/1998 | Ushirogata | 270/58.11 |
| 5,797,596 | A | 8/1998 | Morigami | |
| 7,686,288 | B2 * | 3/2010 | Wetzel et al. | 270/32 |
| 7,740,238 | B2 * | 6/2010 | Iijima et al. | 270/37 |
| 7,980,542 | B2 * | 7/2011 | Kawata et al. | 270/37 |
| 8,262,075 | B2 * | 9/2012 | Shiraishi | 270/58.09 |
| 8,322,701 | B2 * | 12/2012 | Hattori et al. | 270/45 |
| 8,465,012 | B2 * | 6/2013 | Ishikawa et al. | 270/45 |
| 2011/0076081 | A1 * | 3/2011 | Hattori et al. | 400/582 |

* cited by examiner

*Primary Examiner* — Leslie A Nicholson, III
(74) *Attorney, Agent, or Firm* — Canon U.S.A., Inc. IP Division

(57) ABSTRACT

A sheet processing apparatus configured to form a recessed portion at a portion at which a staple is driven into a sheet bundle from a sheet forming a surface of a side into which at least the staple is driven such that a sheet bundle to be discharged next on a sheet bundle stacking unit is stacked on a sheet bundle previously stacked on the sheet bundle stacking unit without catching on a staple of the previously stacked sheet bundle, and an image forming apparatus including the sheet processing apparatus.

12 Claims, 23 Drawing Sheets

SHEET PROCESSING APPARATUS AND IMAGE FORMING APPARATUS

BACKGROUND

1. Field

Aspects of the present invention generally relate to a sheet processing apparatus and an image forming apparatus, and particularly to a configuration that improves alignment of sheet bundles discharged on a stack tray after each of the sheet bundles is bound.

2. Description of the Related Art

Recently, in an image forming apparatus such as a copying machine, a printer, and a facsimile machine, a print system has been widely used in which a sheet processing apparatus is connected to the image forming apparatus. The sheet processing apparatus performs various processing such as binding processing, punching processing, and sorting processing on image-formed sheets. In such a sheet processing apparatus, a metal staple is generally used in the binding processing. When the metal staple is used, sheets are bound with the staple projecting from a surface of the sheet bundle.

However, when bound sheet bundles are sequentially stacked on a stack tray, there are cases where a staple of the sheet bundle already stacked on the stack tray catches on a staple of the sheet bundle to be discharged next, causing deterioration in sheet bundle alignment on the stack tray. Accordingly, U.S. Pat. No. 5,797,596 discusses a technique in which a binding position of a sheet bundle is changed when the predetermined number of copies is bound each time.

For example, as illustrated in FIG. 23, when an odd-numbered sheet bundle SA is bound, a stapling unit is moved by a distance $Y_1$, $Y_2$, or $Y_3$ from a home position H to drive a staple 1000 in. When an even numbered sheet bundle SA is bound, the stapling unit is moved by a distance $Y_1-d$, $Y_2-d$, or $Y_3-d$ to drive the staple 1000 in. This movement distance difference d corresponds to a dimension of the staple 1000 in a width direction perpendicular to a sheet conveyance direction, the dimension of the staple 1000 being provided after the staple 1000 is driven. Consequently, whenever the predetermined number of copies is bound, the binding position is changed in such a manner that bound portions are not overlapped in one location on a stack tray, thereby enhancing alignment of the bound sheet bundles SA.

However, in such a conventional sheet processing apparatus, a change in the binding position for each predetermined number of copies causes sheet bundles to have different binding positions. This generates a plurality of different types of products in spite of the same job. Meanwhile, a position of the stapling unit needs to be shifted to shift the binding positions so that staples have a non-interference relationship with one another. The position of the stapling unit needs to be shifted by an amount greater than a dimension of the staple in a width direction in consideration of deviation in the amount of skew generated when sheet bundles are discharged or an amount of displacement generated when sheet bundles fall to the stack tray.

Consequently, a change in binding position can solve a situation where one staple catches on another. However, when bound sheet bundles are sequentially stacked on the stack tray, there are cases where a projecting portion of the staple of the sheet bundle already stacked on the stack tray catches on an edge of a sheet bundle discharged next. In this case, these sheet bundles are stacked on the stack tray with edge surfaces thereof misaligned and skewed, causing deterioration in alignment of the sheet bundles on the stack tray.

In addition, there are cases where a sheet bundle discharged next may pass over a staple 1000 of an already stacked sheet bundle with inertia without being stuck by the staple 1000 even when the next sheet bundle catches on the staple 1000. In this case, when a sheet edge of the next sheet bundle passes over the staple 1000, an area of the sheet edge is curled or scratched by the staple 1000. Such damage to the sheet edge area causes deterioration in product quality.

SUMMARY

Aspects of the present invention generally relate to a sheet processing apparatus and an image forming apparatus capable of stacking bound sheet bundles without deteriorating alignment and quality of the sheet bundles.

According to an aspect of the present invention, a sheet processing apparatus includes a processing tray on which sheets to be processed are sequentially conveyed and stacked, a binding unit configured to bind the sheets stacked on the processing tray in a sheet bundle by driving a binding member into the sheets, a sheet bundle stacking unit on which the sheet bundles each bound by the binding unit are sequentially discharged, and a recessed portion forming unit configured to form a recessed portion having a predetermined depth in an area corresponding to a position in which the binding member is driven into at least one of a top surface and a bottom surface of the sheet bundle to be bound by the binding unit.

According to an aspect of the present invention, a binding member is driven into a recessed portion formed in a sheet bundle, so that a sheet bundle to be discharged next is prevented from catching on a binding member of a previously stacked sheet bundle, thereby stacking the sheet bundles without deteriorating alignment and quality thereof.

Further features of the present disclosure will become apparent from the following description of exemplary embodiments with reference to the attached drawings.

DESCRIPTION OF THE EMBODIMENTS

Figure 1:
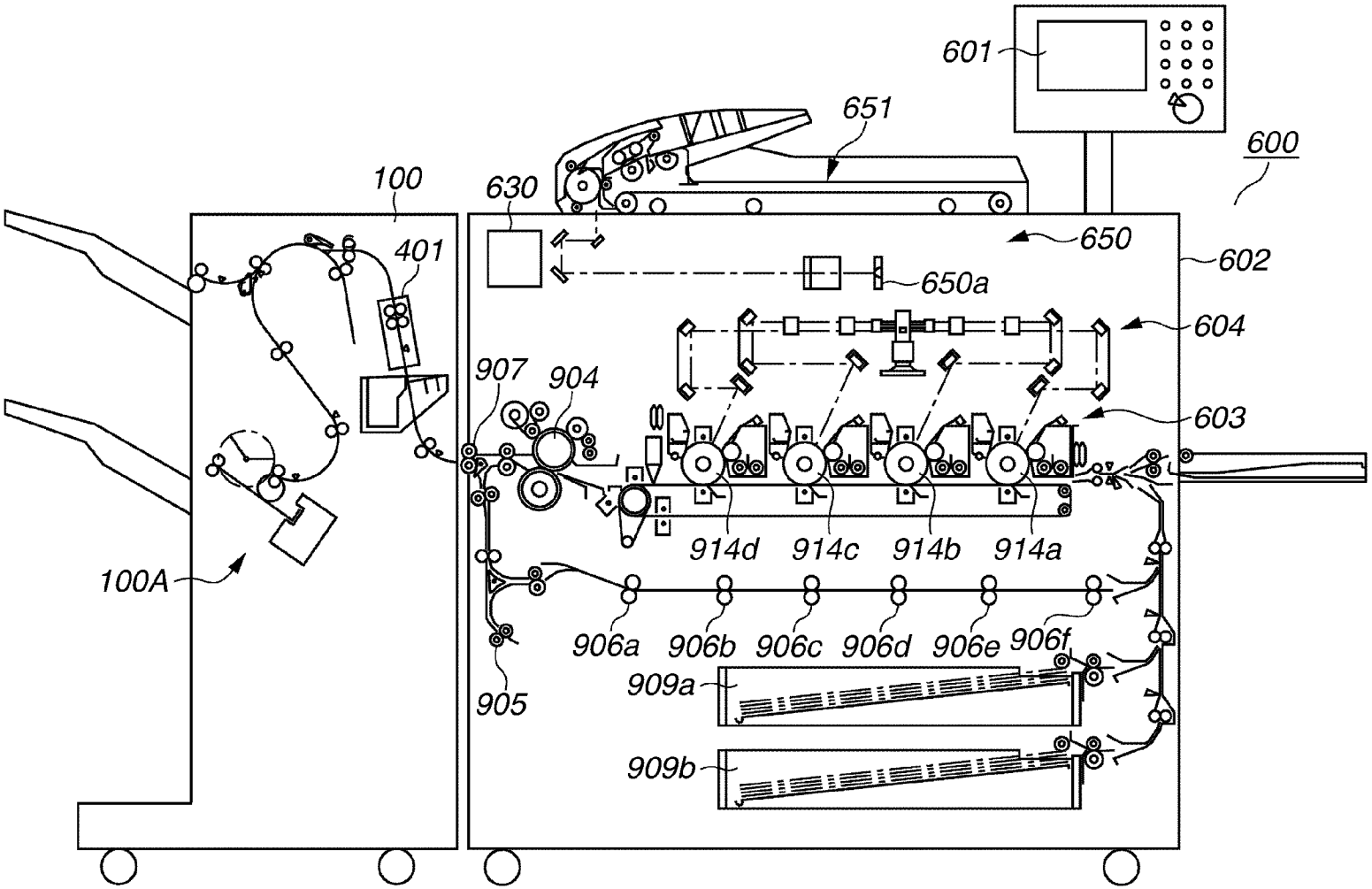
FIG. 1 is a diagram illustrating a configuration of a monochrome/color copying machine as one example of an image forming apparatus including a sheet processing apparatus according to a first exemplary embodiment.

Various exemplary embodiments, features, and aspects of the invention will be described in detail below with reference to the drawings. FIG. 1 is a diagram illustrating a configuration of a monochrome/color copying machine as one example of an image forming apparatus including a sheet processing apparatus according to an exemplary embodiment. A monochrome/color copying machine 600 includes a monochrome/color copying machine main body (hereinafter, referred to as a copying machine main body) 602, a document reading unit (i.e., an image reader) 650 provided in an upper portion of the copying machine main body 602, and a document conveyance apparatus 651 for conveying a plurality of documents so that the plurality of documents are automatically read.

The copying machine main body 602 includes sheet feeding cassettes 909*a* and 909*b* in which normal sheets S used for image formation are stacked, an image forming unit 603 for forming a toner image on a sheet S using an electrophotographic process, and a fixing unit 904 for fixing the toner image formed on the sheet S. In addition, an operation unit 601 and a finisher 100 serving as a sheet processing apparatus are respectively connected to the top and a side of the copying machine main body 602. A user uses the operation unit 601 to perform various inputs and settings to the copying machine main body 602. A central processing unit (CPU) circuit unit 630 serving as a control unit controls the copying machine main body 602 and the finisher 100.

Such a monochrome/color copying machine 600 performs the following operations when an image on a document (not illustrated) is formed on a sheet. First, an image sensor 650*a* provided in the document reading unit 650 reads an image on a document conveyed by the document conveyance apparatus 651. The digital data read by the image sensor 650*a* is input to an exposure device 640, and the exposure device 640 emits light corresponding to the digital data to photosensitive drums 914 (914*a* through 914*d*) provided in the image forming unit 603, thereby forming electrostatic latent images on surfaces of the photosensitive drums 914. These electrostatic latent images are developed, and toner images of yellow, magenta, cyan, and black are formed on the respective surfaces of the photosensitive drums 914.

Next, the four-color toner images are transferred to a sheet conveyed from the sheet feeding cassette 909*a* or 909*b*. Then, the four-color toner image transferred to the sheet is permanently fixed by the fixing unit 904. If the image forming operation is performed in a one-sided mode, the sheet with the fixed toner image is simply discharged by a pair of discharge rollers 907 to the finisher 100 connected to the side of the monochrome/color copying machine 600.

If the image forming operation is performed in a two-sided mode, the sheet with the toner image is transferred from the fixing unit 904 to a reversing roller 905. The reversing roller 905 is reversely rotated at a predetermined timing, so that the sheet is conveyed toward two-sided conveyance rollers 906*a* through 906*f*. Then, the sheet is again conveyed to the image forming unit 603, and toner images of four colors of yellow, magenta, cyan, and black are transferred to a back side of the sheet. The sheet with the four-color toner image on the back side is conveyed to the fixing unit 904 again, and the toner image is fixed by the fixing unit 904. Subsequently, the sheet is discharged by the discharge roller pair 907 and conveyed to the finisher 100.

The finisher 100 sequentially receives the sheets discharged from the copying machine main body 602, and performs bundling processing and punching processing. In the bundling processing, a plurality of received sheets is aligned and bundled into one bundle. In the punching processing, a hole is made near a trailing edge of each of the received sheets. Moreover, the finisher 100 performs various processing such as sort/non-sort processing, folding processing for folding a sheet bundle, a folio bookbinding processing, and binding processing for biding an upstream edge (hereinafter called a trailing edge) of a sheet bundle in a sheet discharge direction. For the various processing, the finisher 100 includes a stapling unit 100A serving as a binding unit for biding sheets, a shift unit 401 for shifting a sheet to a width direction perpendicular to the sheet conveyance direction, and a folding device (not illustrated).

Figure 2:
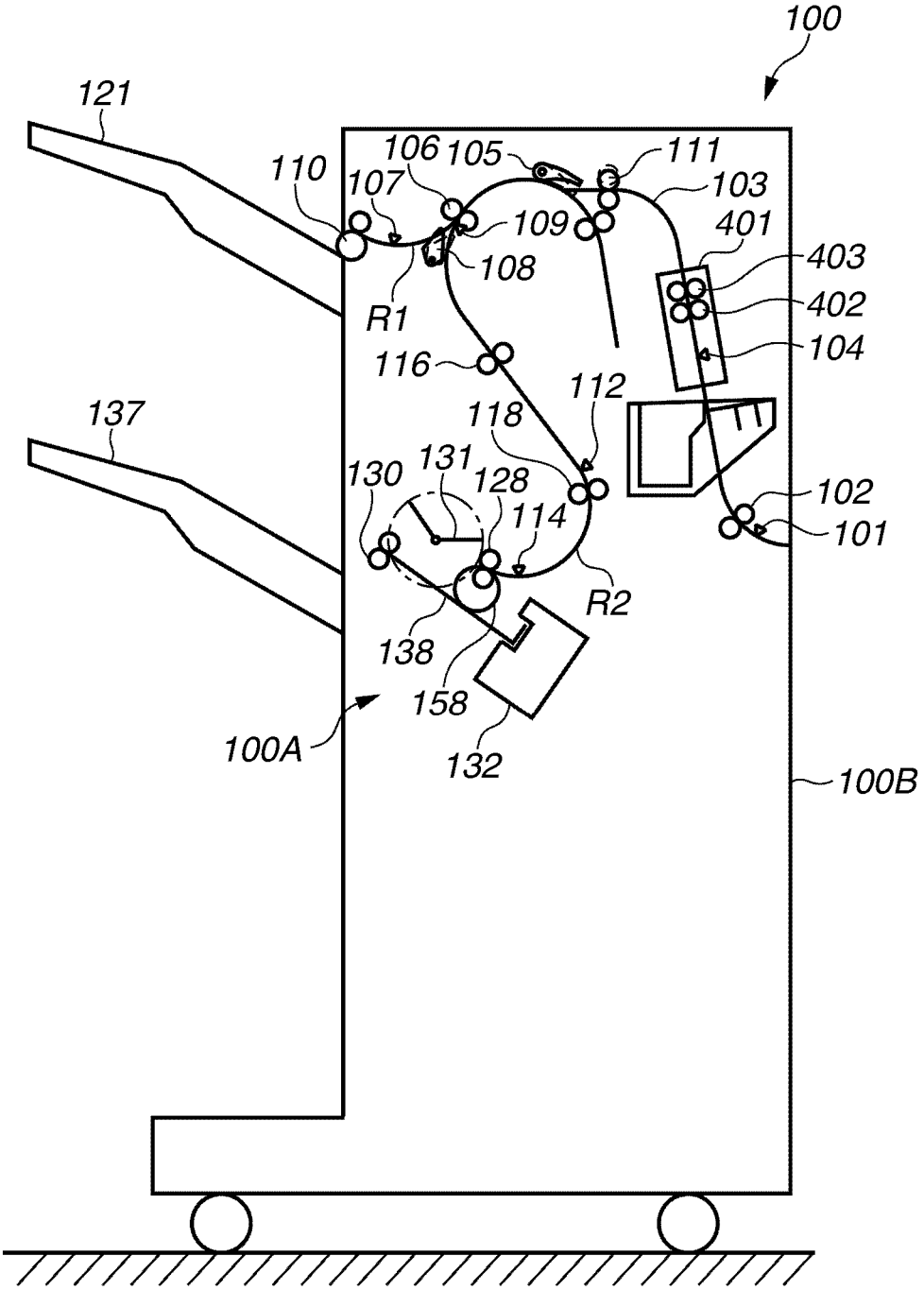
FIG. 2 is a diagram illustrating a configuration of a finisher as the sheet processing apparatus.

As illustrated in FIG. 2, the finisher 100 includes an inlet roller pair 102 for taking a sheet to the inside thereof. The sheet discharged from the copying machine main body 602 is transferred to the inlet roller pair 102. At this time, an inlet sensor 101 detects sheet transfer timing.

Then, a lateral registration detection sensor 104 detects an edge position of the sheet conveyed by the inlet roller pair 102 while the sheet is passing along the conveyance path 103. The lateral registration detection sensor 104 detects how much the sheet has deviated in a width direction from a center position of the finisher 100. After the width direction deviation (hereinafter, referred to as a lateral registration error) of the sheet is detected, the sheet is shifted by the shift unit 401 while being conveyed to the shift roller pairs 402 and 403. The shift unit 401 moves a predetermined distance in a front direction or a rear direction, so that the sheet is shifted. Herein, "front" represents a front side of the apparatus as viewed from a user when the user stands to operate the operation unit 601 illustrated in FIG. 1, whereas "rear" represents a back side of the apparatus.

After the lateral registration error of the sheet is corrected by the shift unit 401, the sheet is conveyed by a conveyance roller pair 111 and reaches a buffer roller pair 106. Then, if the sheet needs to be discharged on an upper tray 121, an upper path switching member 108 is rotated clockwise by a drive unit (not illustrated) such as a solenoid. Accordingly, the sheet is guided to an upper conveyance path R1, and discharged on the upper tray 121 by an upper discharge roller 110. If the sheet does not need to be discharged to the upper tray 121, the sheet conveyed by the buffer roller pair 106 is guided to a bundle conveyance path R2 by the upper path switching member 108. Subsequently, the sheet passes along the conveyance path by a conveyance roller 116 and a bundle conveyance roller pair 118 in sequence.

If the conveyed sheet needs to undergo folding processing, the sheet is conveyed toward a folding device (not illustrated). Moreover, if the conveyed sheet needs to be discharged on a lower discharge tray 137, each of the sheets is sequentially conveyed by a lower discharge roller pair 128 to an intermediate processing tray 138 serving as a processing tray. The conveyed sheets are aligned by a return unit such as a paddle 131 and a belt roller 158 while being stacked in sequence on the intermediate processing tray 138, thereby forming an aligned sheet bundle.

Each of the sheet bundles aligned on the intermediate processing tray 138 is bound by a stapler 132 serving as a binding unit as needed, and sequentially discharged on the lower discharge tray 137 serving as a sheet bundle stacking unit by a bundle discharge roller pair 130. This stapler 132 is movable in a width direction (also referred to as a depth direction) perpendicular to the sheet conveyance direction, and can perform biding processing on an edge of a sheet bundle in the conveyance direction. In the present exemplary embodiment, the stapler 132 can perform the binding processing in a plurality of locations on the edge of a sheet bundle in a conveyance direction.

Figure 3:
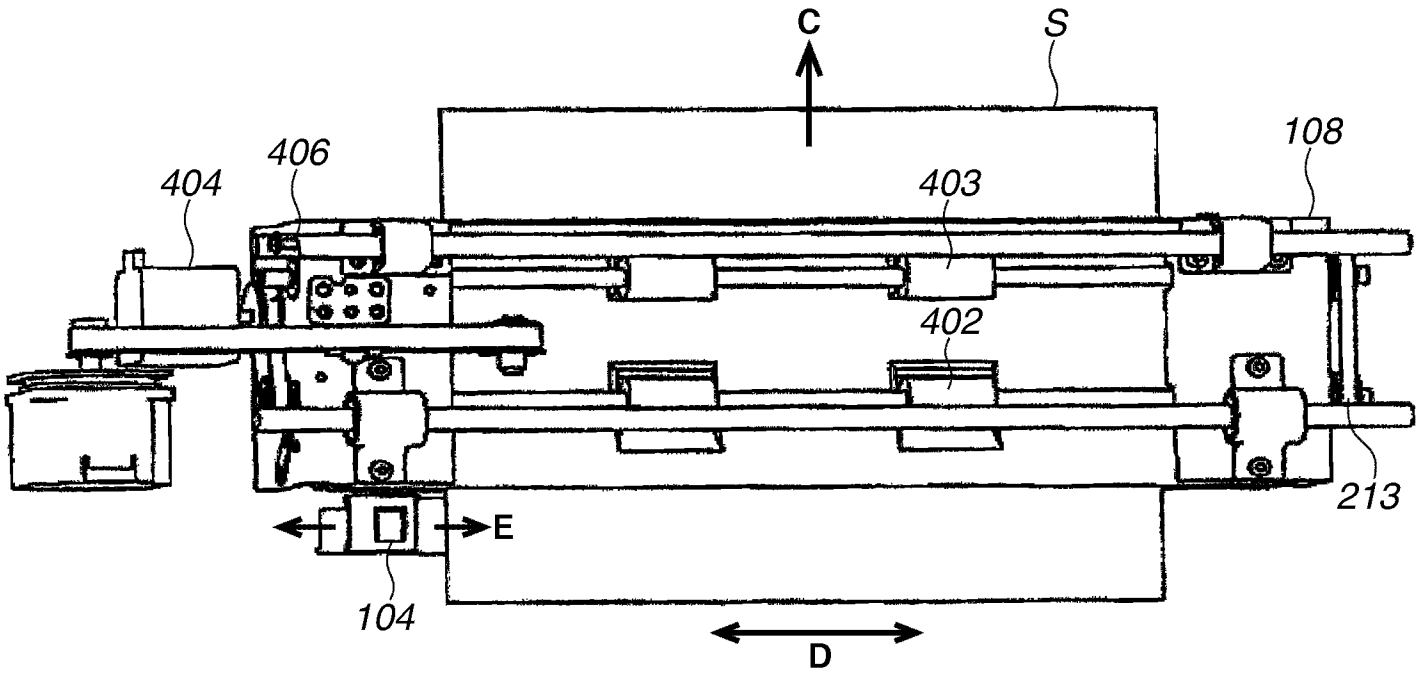
FIG. 3 is a diagram illustrating a configuration of a shift unit provided in the finisher.

The shift unit 401 includes a shift roller pairs 402 and 403 as illustrated in FIG. 3. When a sheet is conveyed, the shift unit 401 drives a shift conveyance motor 404. This drive of the shift conveyance motor 404 is transmitted to the shift roller pair 403 through a drive belt 406 to drive the shift roller pair 403. Moreover, the drive of the shift roller pair 403 is transmitted to the shift roller pair 402 through the drive belt 213 to drive the shift roller pair 402, thereby conveying a sheet S in a direction indicated by an arrow C illustrated in FIG. 3.

Herein, the lateral registration detection sensor 104 is moved by a drive unit (not illustrated) in a direction indicated by an arrow E illustrated in FIG. 3, so that a position (a lateral registration error X) of the sheet S is detected. During conveyance of the sheet S, the sheet S is shifted by an amount of Z (=X+α) that is addition of the lateral registration error X and a shift amount a of the sheet S. Such a shift is made in the front direction and the rear direction (an area indicated by an arrow D illustrated in FIG. 3) while the sheet S is being pinched by the shift roller pairs 402 and 403. Consequently, the sheet S can be shifted by a predetermined amount while being conveyed in a conveyance direction C. In the present exemplary embodiment, these shift roller pairs 402 and 403 can rotate in normal and reverse directions. The shift roller pairs 402 and 403 reversely rotate to switchback and convey the sheet when a recessed portion is formed in an area near a trailing edge of the sheet.

Figure 4:
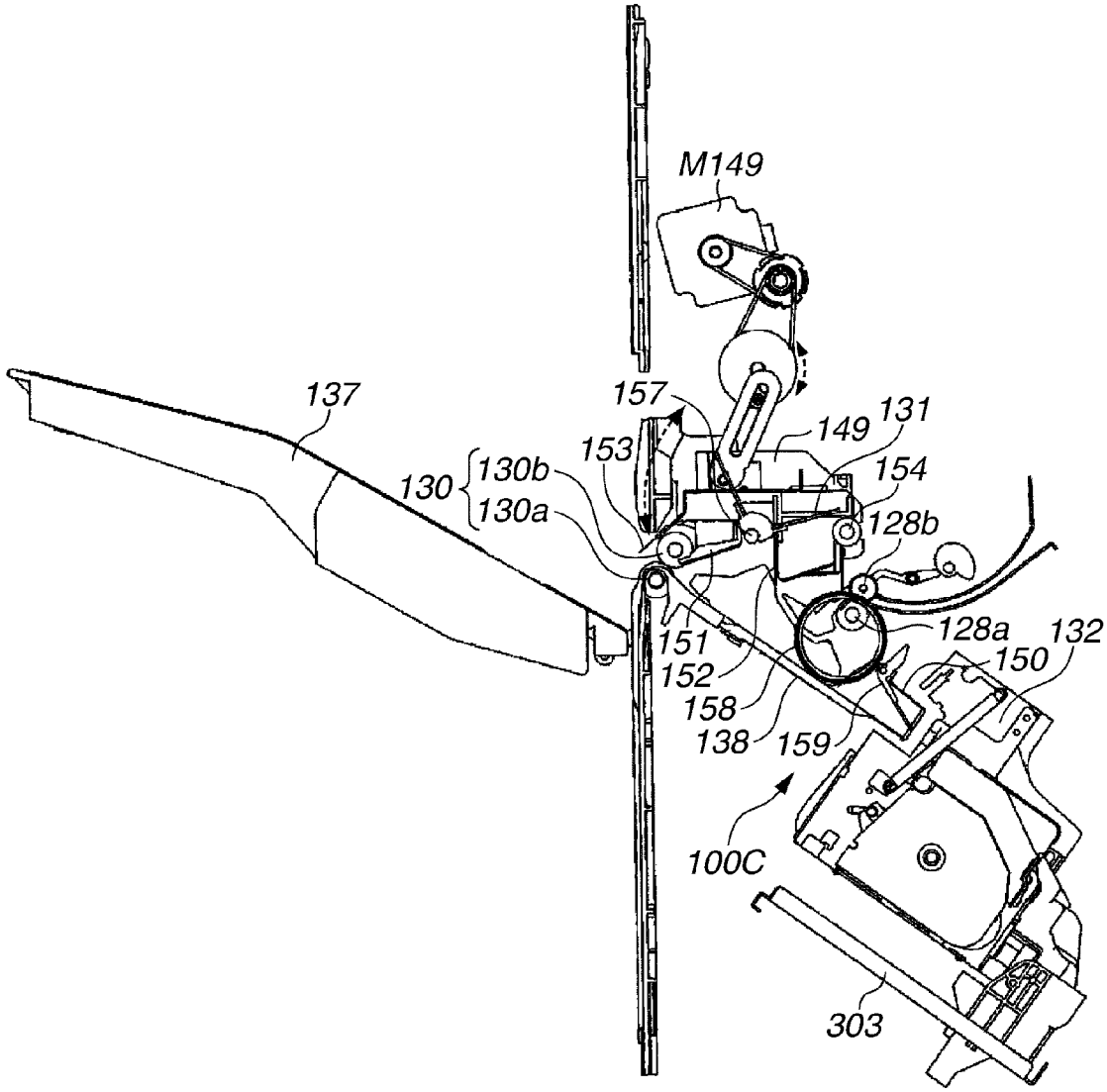
FIG. 4 is a diagram illustrating a configuration of a stapling unit provided in the finisher.

Now, a configuration of the stapling unit 100A including the intermediate processing tray 138 is described. As illustrated in FIG. 4, the intermediate processing tray 138 is disposed in an inclined manner such that a downstream side thereof (a left side in FIG. 4) relative to a sheet bundle discharge direction is arranged in an upper position, whereas an upstream side thereof (a right side in FIG. 4) is arranged in a lower position. A trailing edge stopper 150 is disposed in a lower edge of the intermediate processing tray 138, that is, the upstream side of the intermediate processing tray 138. The intermediate processing tray 138 may be horizontally disposed.

Figure 5:
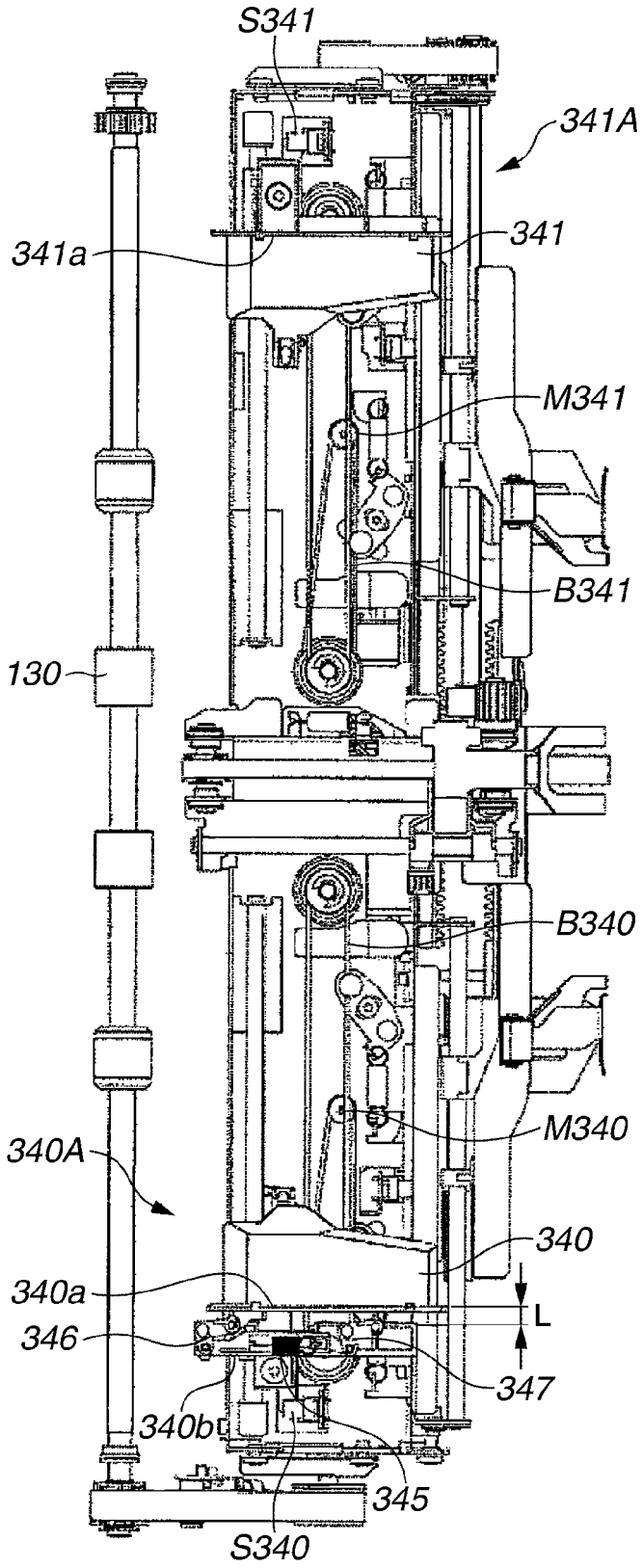
FIG. 5 is a diagram illustrating a configuration of an intermediate processing tray provided in the stapling unit.

The intermediate processing tray 138 includes a front alignment unit 340A and a rear alignment unit 341A in a middle portion thereof as illustrated in FIG. 5. In the middle portion of the intermediate processing tray 138, side edge regulation units serving as width direction alignment units are disposed. The side edge regulation units regulate (align) edge positions on both sides in a width direction of the sheet conveyed to the intermediate processing tray 138. Herein, the front and rear alignment units 340A and 341A respectively include front and rear alignment plates 340 and 341 serving as alignment members, and front and rear alignment plate motors M340 and M341. The front and rear alignment plates 340 and 341 respectively include alignment units 340*a* and 341*a* forming alignment surfaces, and the front and rear alignment plate motors M340 and M341 independently drive the respective front and rear alignment plates 340 and 341.

When the both side edge positions of the sheet are regulated, the drives of the front and rear alignment plate motors M340 and M341 are transmitted to the front and rear alignment plates 340 and 341 through timing belts B340 and B341, respectively. The timing belts B340 and B341 form movement units with the front and rear alignment plate motors M340 and M341. Therefore, the front and rear alignment plates 340 and 341 separably contacting the sheet move independently along the width direction relative to the intermediate processing tray 138, and contact both side edges of the sheet stacked on the intermediate processing tray 138 to align the sheet.

That is, the front alignment plate 340 and the rear alignment plate 341 are disposed facing the respective alignment units (alignment surfaces) 340*a* and 341*a* on the intermediate processing tray 138, and are mounted to be movable normally and reversely in an alignment direction. As a result, even when a sheet (or a sheet bundle) is shifted and conveyed in a width direction, a position of the sheet on the intermediate processing tray 138 can be aligned by the front and rear alignment plates 340 and 341.

For example, the alignment unit 340*a* including the alignment surface of the front alignment plate 340 as one of the alignment plates is movably disposed in the width direction. Moreover, an extension spring 345 is provided between the alignment unit 340*a* and a main body 340*b* of the front alignment plate 340. This extension spring 345 and movement links 346 and 347 enable the alignment unit 340*a* to project toward a sheet side by a predetermined amount L. Accordingly, when a side edge position of the sheet is regulated, the alignment unit 340*a* presses and contacts the sheet, and then moves toward a main body side while acting against the extension spring 345 as described below.

In FIG. 5, front and rear alignment plate home sensors 5340 and 5341 detect home positions of the front alignment plates 340 and 341, respectively. The arrangement of the front and rear alignment plate home sensors 5340 and 5341 enables the respective front alignment plates 340 and 341 to be on standby in the home positions when these plates 340 and 341 are not in operation. The home positions are set in both edges.

Figure 6:
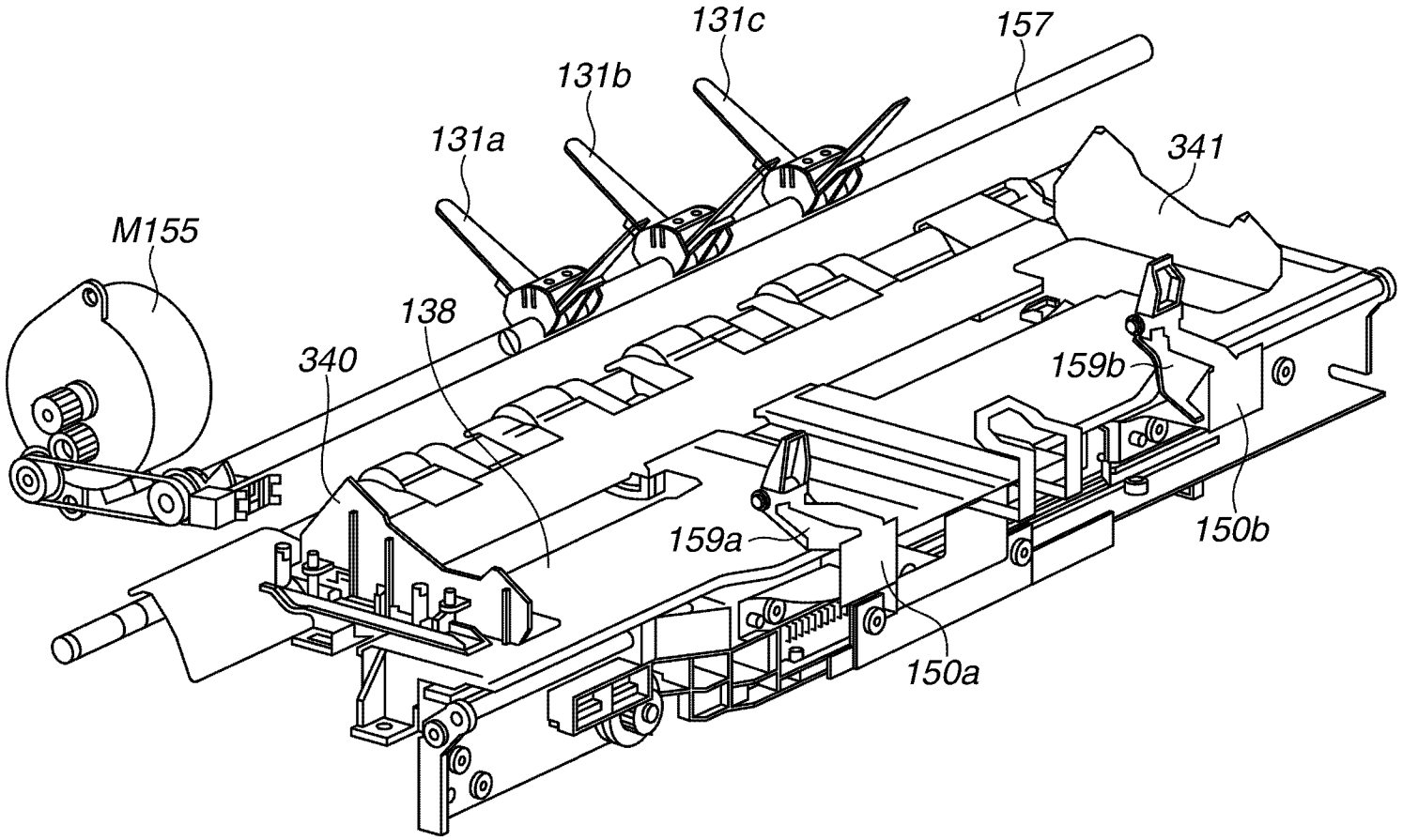
FIG. 6 is a diagram illustrating a configuration of a sheet trailing edge alignment unit provided in the stapling unit.

Moreover, as illustrated in FIG. 4, the pull-in paddles 131 and an opening/closing guide 149 are provided in an upper edge portion, that is, on a downstream side of the intermediate processing tray 138 in a pull-in direction. The pull-in paddles 131 (131*a* through 131*c*) are disposed above the intermediate processing tray 138. As illustrated in FIG. 6, a plurality of pull-in paddles 131 is fixed on a drive shaft 157 that is rotated by a paddle drive motor M155. In FIG. 4, the pull-in puddles 131 are rotated counterclockwise by the paddle drive motor M155 at an appropriate timing to pull in the sheet, and thus the sheet contacts trailing edge stoppers 150 (150*a*, 150*b*).

According to the present exemplary embodiment, when the sheet is pulled into the trailing edge stoppers 150 by the plurality of pull-in puddles 131, each of the pull-in puddles 131 evenly contacts a surface of the sheet. Consequently, such an arrangement of the plurality of pull-in puddles 131 can not only prevent a rotation of the sheet due to the uneven contact with the pull-in puddles, but also enables the sheet to reliably contact the trailing edge stoppers 150 without a skew of the sheet.

In FIG. 4, a sheet rear edge alignment unit 100C, serving as a conveyance direction alignment unit, aligns a position of the sheet in a conveyance direction. This sheet rear edge alignment unit 100C includes a belt roller 158, rear edge levers 159 (159*a*, 159*b*) as illustrated in FIG. 6, and the trailing edge stoppers 150 serving as a regulation member contacting an upstream side edge of the sheet in a conveyance direction. The counterclockwise rotation of the pull-in puddles 131 and the belt roller 158 causes the conveyance-direction upstream side edge of the sheet on the intermediate processing tray 138 to contact the trailing edge stoppers 150 while the sheet is guided by the rear edge levers 159. Thus, the position of the sheet in the conveyance direction is aligned.

The belt roller 158, which is an endless belt, capable of vertically moving is disposed above the intermediate processing tray 138, and wound around the outer circumference of a first discharge roller 128*a* included in the lower discharge roller pair 128 illustrated in FIG. 4. The belt roller 158 is rotated counterclockwise with rotation of the first discharge roller 128*a* in such a manner that a lower portion thereof is positioned to contact the top sheet among the sheets stacked on the intermediate processing tray 138. Accordingly, the sheet conveyed on the intermediate processing tray 138 is conveyed in a direction opposite the conveyance direction and contacts the trailing edge stoppers 150.

Moreover, as illustrated in FIG. 4, the opening/closing guide 149 is rotatably supported around a support shaft 154, and disposed as an upper side conveyance guide opposing the intermediate processing tray 138. The opening/closing guide 149 rotatably retains an upper bundle discharge roller 130*b*. The upper bundle discharge roller 130*b* and a lower bundle discharge roller 130*a* form the bundle discharge roller pair 130. The lower bundle discharge roller 130*a* is disposed in a downstream side edge of the intermediate processing tray 138.

The upper bundle discharge roller 130*b* contacts to and separates from the lower bundle discharge roller 130*a* with a swing of the opening/closing guide 149 retaining the upper bundle discharge roller 130*b* in a contactable and separable manner with respect to the lower bundle discharge roller 130*a*. The opening/closing guide 149 generally swings upward when a sheet is conveyed to the intermediate processing tray 138. This upward swing of the opening/closing guide 149 enables the upper bundle discharge roller 130*b* to be separated from the lower bundle discharge roller 130*a* as the other roller of the bundle discharge roller pair 130, thereby becoming an open state.

Moreover, when sheet processing on the intermediate processing tray 138 is finished, the opening/closing guide 149 swings downward so that the upper bundle discharge roller 130*b* and the lower bundle discharge roller 130*a* pinch a sheet bundle. The bundle discharge roller pair 130 (e.g., the lower bundle discharge roller 130*a*) is rotated in normal and reverse directions by a bundle discharge drive motor M130 (see FIG. 15). Then, when the bundle discharge roller pair 130 is rotated with the sheet bundle pinched thereby, the sheet bundle is discharged to the lower discharge tray 137.

When the sheet to be processed is conveyed to the intermediate processing tray 138, the opening/closing guide 149 swings upward. Accordingly, the sheet conveyed from the lower discharge roller pair 128 is slid down on a stacking surface of the intermediate processing tray 138 or the sheet already stacked on the intermediate processing tray 138 by the inclination of the intermediate processing tray 138 and the action of the pull-in puddles 131. This slid-down sheet is conveyed with the counterclockwise rotation of the belt roller 158 while being guided by the rear edge levers 159. The conveyance of the sheet stops when a trailing edge of the sheet (an upstream edge in a conveyance direction) contacts the trailing edge stoppers 150.

Moreover, the opening/closing guide 149 includes a guide 151 positioned at an upstream portion of the upper bundle discharge roller 130*b*. The guide 151 guides the sheet to a roller nip portion of the upper bundle discharge roller 130*b*. In the opening/closing guide 149, a first static charge eliminator 152 is disposed across an axial direction. The first static charge eliminator 152 removes electric charge from a surface of the sheet when the sheet is discharged from the lower discharge roller pair 128 into the intermediate processing tray 138. Moreover, in the opening/closing guide 149, a second static charge eliminator 153 is disposed in a downstream portion of the upper bundle discharge roller 130*b*. The second static charge eliminator 153 is disposed across the axis direction, and removes electric charge from a surface of the sheet discharged by the bundle discharge roller pair 130.

Figure 7:
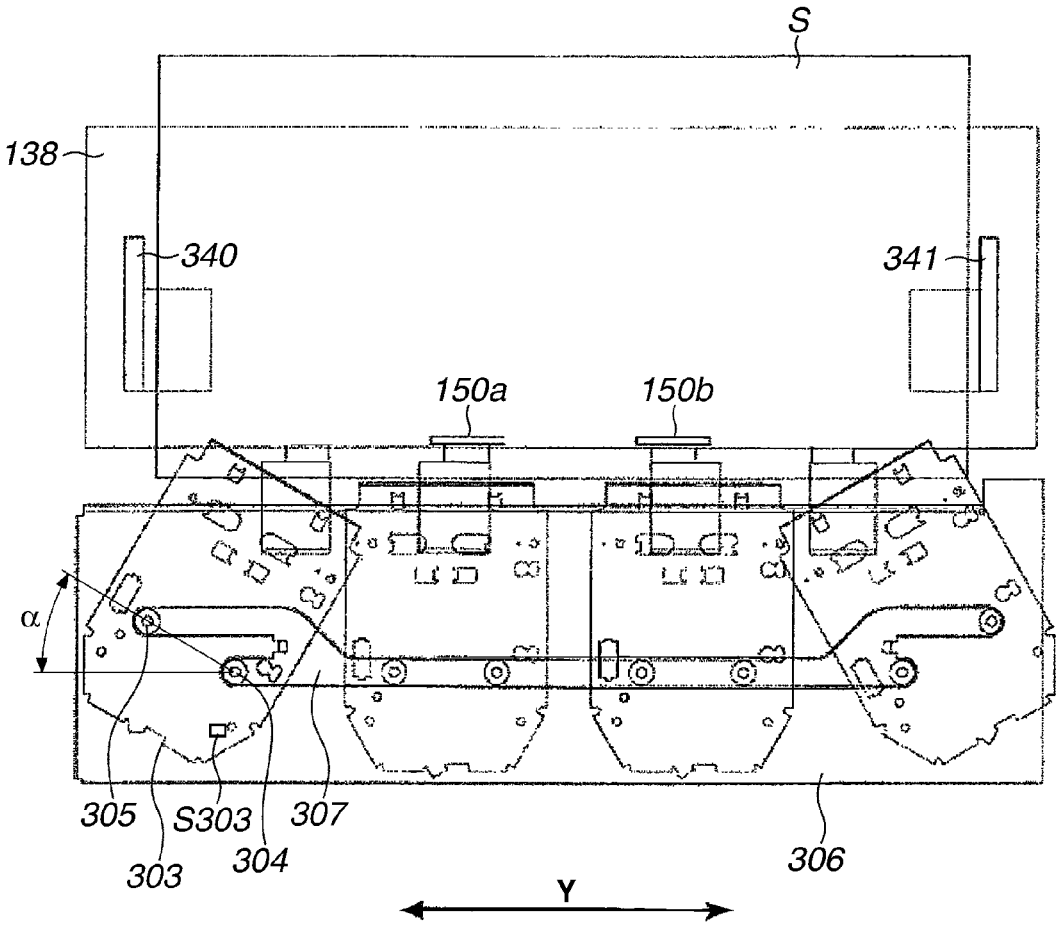
FIG. 7 is a diagram illustrating a stapler provided in the stapling unit.

The stapling unit 100A includes the stapler 132 serving as a binding unit (processing unit). The stapler 132 binds an edge of a sheet bundle by using a clinch motor (not illustrated), and is fixed on a slide support base 303. As illustrated in FIG. 7, rollers 304 and 305 are provided underneath the slide support base 303, and a guide rail groove 307 is formed on an upper surface of a stapler movement base 306. The slide support base 303 is guided by the rollers 304 and 305 and the guide rail groove 307 formed on the stapler movement base 306, and is moved by a stapler moving motor (not illustrated) along a trailing edge of the sheet on the intermediate processing tray 138 in a direction indicated by an arrow Y illustrated in FIG. 7.

The stapler 132, in a corner of the sheet S stacked on the intermediate processing tray 138, remains inclined by a predetermined angle $\alpha$ relative to a trailing edge of the sheet S. Although the inclination angle $\alpha$ is set to approximately 30 degrees, the angle $\alpha$ can be changed by changing a shape of the guide rail groove 307. Moreover, the stapler movement base 306 includes a stapler home sensor 5303 for detecting a home position of the stapler 132. Normally, the stapler 132 is on standby in a home position at the front side of the apparatus.

In the present exemplary embodiment, the finisher 100 selectively performs recessed portion forming processing for forming a recessed portion near the trailing edge of the conveyed sheet. For the recessed portion forming processing, as illustrated in FIG. 2, the finisher 100 includes a recessed portion forming device 201 including a recessed portion forming unit on an upstream side of the shift unit 401 in the sheet conveyance direction.

Figure 8:
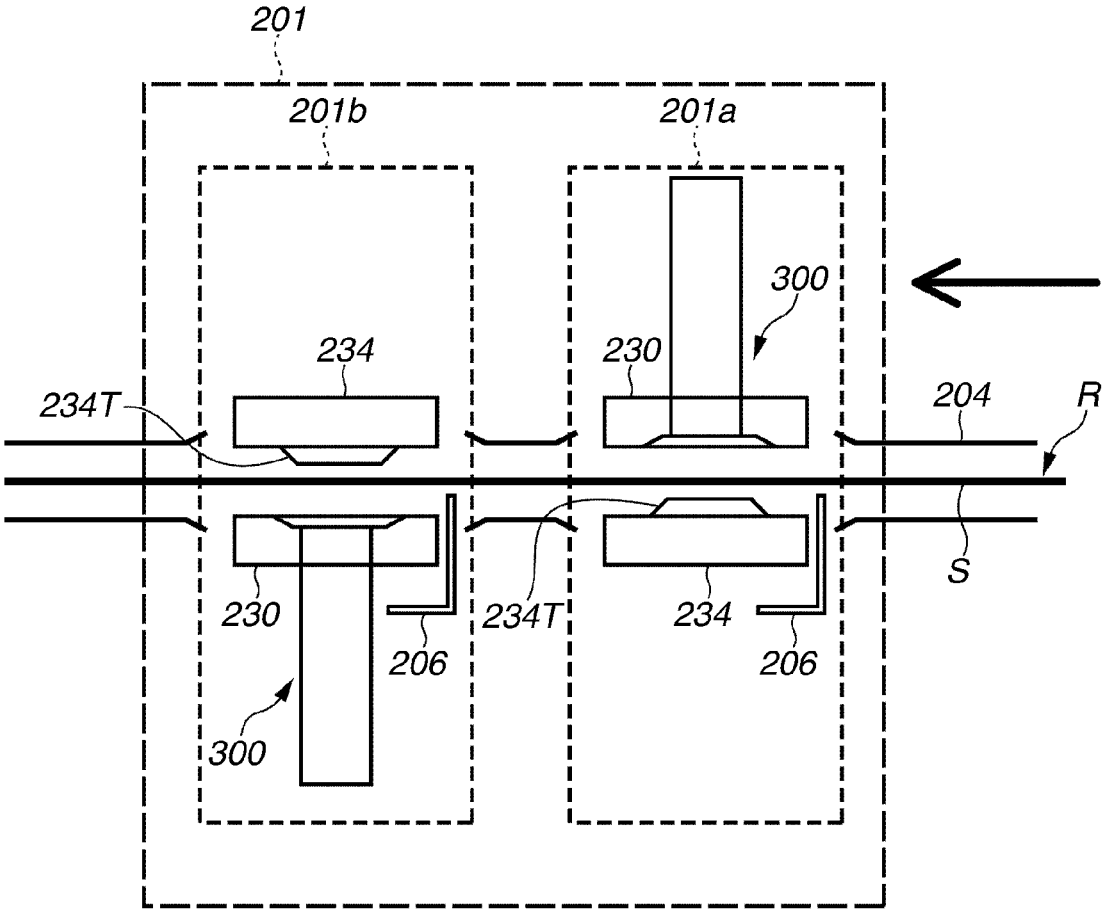
FIG. 8 is a diagram illustrating a configuration of a recessed portion forming device provided in the finisher.

As illustrated in FIG. 8, the recessed portion forming device 201 is disposed along the sheet conveyance direction, and includes a first recessed portion forming unit 201*a* and a second recessed portion forming unit 201*b* each of which includes a recessed portion forming die 234 and a recessed portion forming punch 230. Each of the first and second recessed portion forming units 201*a* and 201*b* causes the recessed portion forming die 234 and the recessed portion forming punch 230 to pinch and press the sheet S therebetween, thereby forming a recessed shape on the sheet S.

In the present exemplary embodiment, since the first and second recessed portion forming units 201*a* and 201*b* form recessed portions in opposite directions, the recessed portion forming device 201 can form a recessed portion in either direction of a sheet surface. That is, the recessed portion forming device 201 can form a recessed portion recessed downward on an upper surface of the sheet, and a recessed portion recessed upward on a lower surface of the sheet. In the present exemplary embodiment, the first recessed portion forming unit 201*a* forms a recessed portion recessed upward on a lower surface of the sheet, whereas the second recessed portion forming unit 201*b* forms a recessed portion recessed downward on an upper surface of the sheet.

Next, a configuration of the first and second recessed portion forming unit 201*a* and 201*b* is described. Since the first and second recessed portion forming unit 201*a* and 201*b* are similar to each other except for the recessed portion formation directions, only the first recessed portion forming unit 201*a* is described while a description of the second recessed portion forming unit 201*b* is omitted.

Figure 9A:
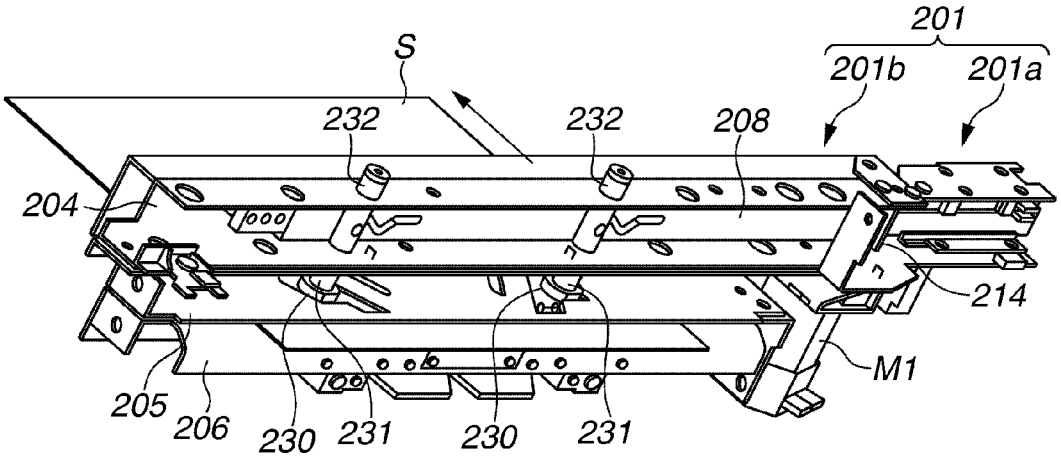
FIGS. 9A and 9B are diagrams illustrating a configuration of a first recessed portion forming unit provided in the recessed portion forming device.
Figure 9B:
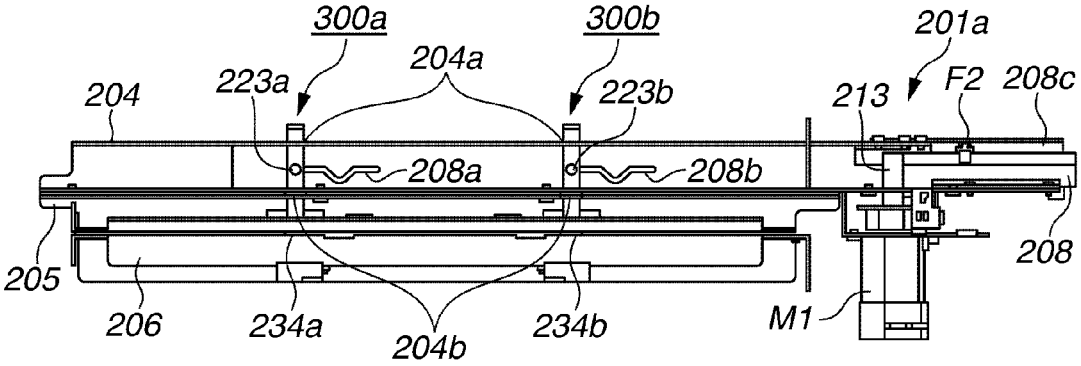

As illustrated in FIG. 9A, the first recessed portion forming unit 201*a* includes a conveyance guide 205, and a recessed portion forming die support guide 206 swaged and fixed to the conveyance guide 205. The recessed portion forming die support guide 206 forms a conveyance path on which the sheet S is conveyed between the conveyance guide 205 and the recessed portion forming die support guide 206. As illustrated in FIG. 9B, the recessed portion forming dies 234 (234*a* and 234*b*) are fixed to the recessed portion forming die support guide 206. A leading end of the recessed portion forming die 234 has a projecting portion 234T projecting from a conveyance path R to form a recessed portion as illustrated in FIG. 8.

Figure 10A:
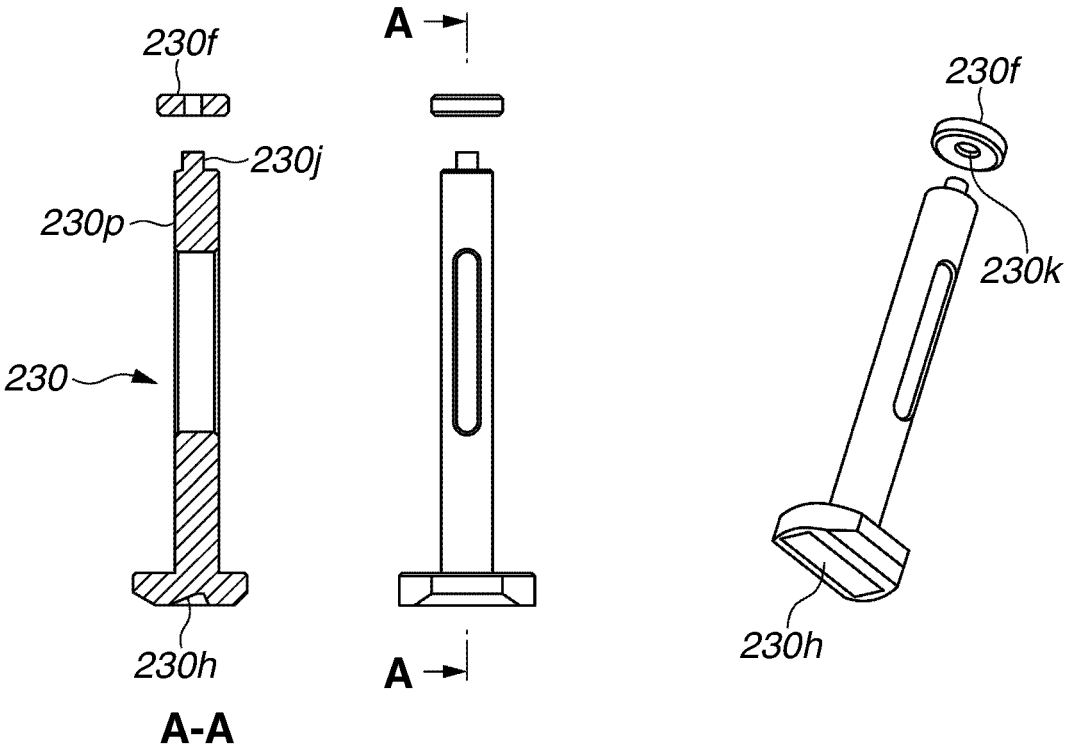
FIGS. 10A and 10B are diagrams illustrating the recessed portion forming unit provided in the recessed portion forming device.
Figure 10B:
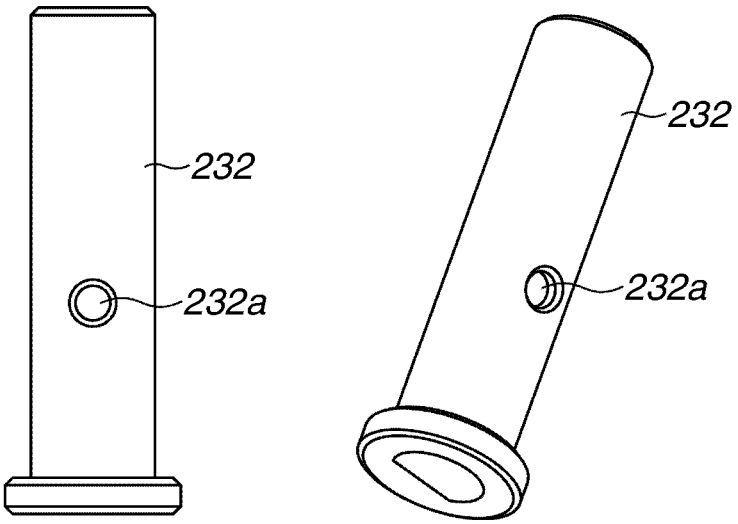

Moreover, a recessed portion forming support guide 204 is swaged and fixed to the conveyance guide 205. On the recessed portion forming support guide 204, each of punch units 300 (300*a* and 300*b*) is slidably supported through upper and lower slide support holes 204*a* and 204*b*. As illustrated in FIGS. 10A and 10B, the punch unit 300 includes the recessed portion forming punch 230, a recessed portion forming slider 232, and a recessed portion formation pressing spring 231 illustrated in FIGS. 11A, 11B, and 11C.

As illustrated in FIG. 10A, the recessed portion forming punch 230 includes a punch portion 230*p* and a lid 230*f*, and a recessed shape portion 230*h* is formed at the bottom of the punch portion 230*p*. The sheet S is pinched by the recessed shape portion 230*h* and the projecting portion 234T of the recessed portion forming die 234, so that a recessed portion is formed on the sheet. Moreover, a male screw-shaped shaft 230*j* is arranged at the top of the punch portion 230*p*. The lid 230*f* is fastened to the punch portion 230*p* by screwing the male screw-shaped shaft 230*j* into a female screw portion 230*k* of the lid 230*f*. As illustrated in FIG. 10B, the recessed portion forming slider 232 is a hollow cylinder, and has a round hole in the center thereof. The round hole is formed to place therein a parallel pin 223*a* illustrated in FIGS. 12A and 12B.

Figure 11A:
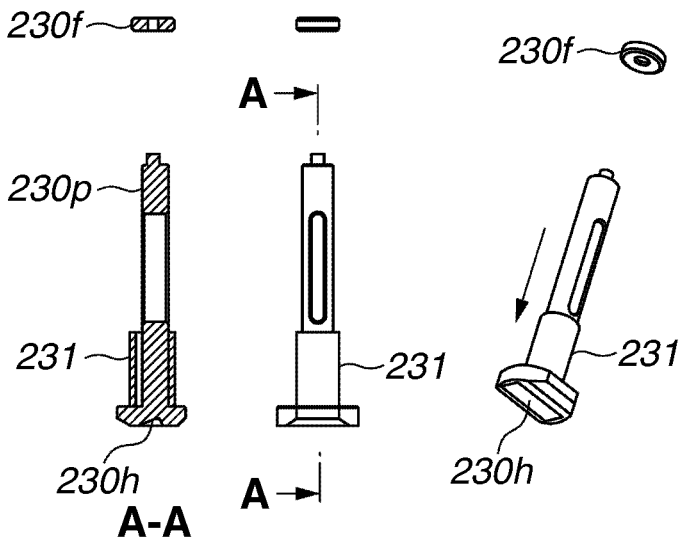
FIGS. 11A, 11B, and 11C are diagrams illustrating an assembly order of the recessed portion forming unit.
Figure 11B:
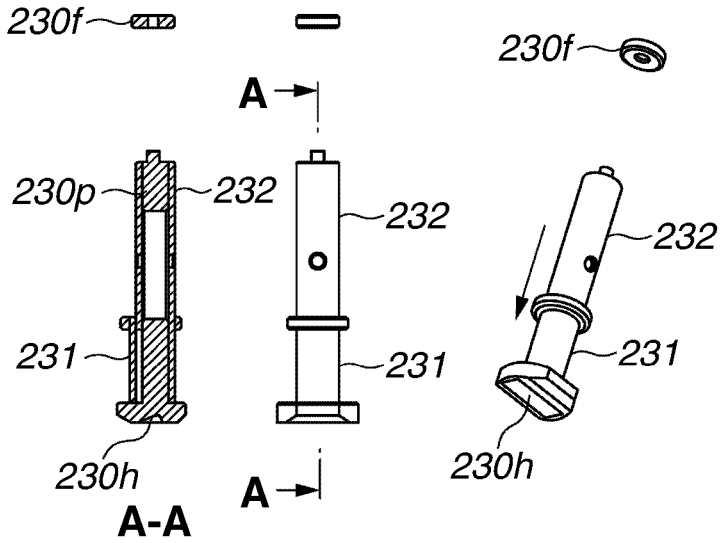
Figure 11C:
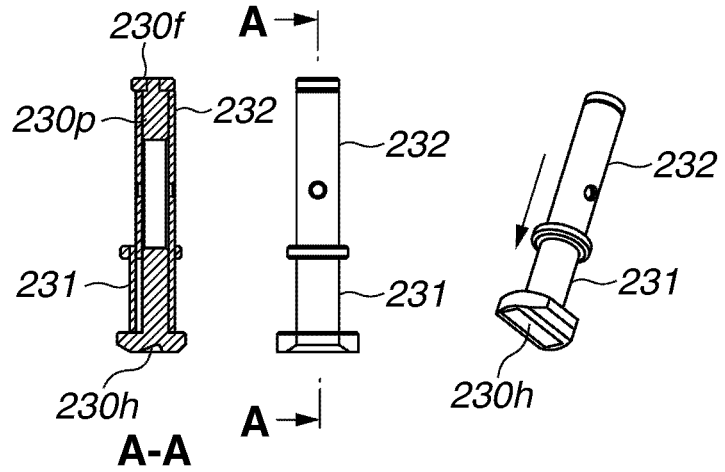

Next, an assembly order of the punch unit 300 including the recessed portion forming punch 230 is described. First, as illustrated in FIG. 11A, the recessed portion formation pressing spring 231 is slid down from above to the punch portion 230*p* of the recessed portion forming punch 230. Similarly, the recessed portion forming slider 232 is slid down from above to the recessed portion forming punch 230 as illustrated in FIG. 11B. Then, the lid 230*f* is fastened from above on the top of the punch portion 230*p*, and the assembly of the punch unit 300 is completed as illustrated in FIG. 11C.

In the punch unit 300 assembled in this way, the recessed portion forming punch 230 is vertically slidable inside the recessed portion forming slider 232. The recessed portion forming punch 230 is positioned by contacting an underside of the lid 230*f* and the top surface of the recessed portion forming slider 232 each other when being pressed downward by the recessed portion formation pressing spring 231 arranged between the recessed portion forming punch 230 and the recessed portion forming slider 232.

Figure 12A:
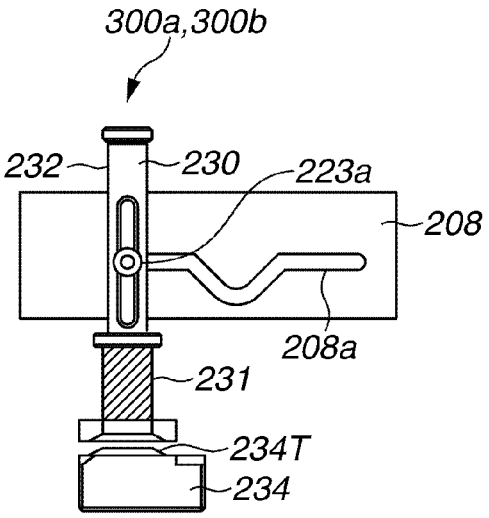
FIGS. 12A, 12B, 12C, and 12D are diagrams illustrating a recessed portion forming operation performed by the recessed portion forming device.
Figure 12B:
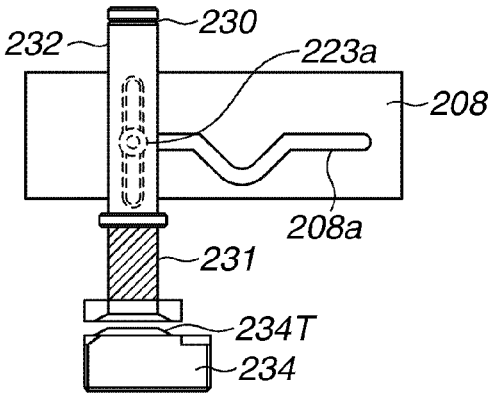

After the punch unit 300 is assembled, the parallel pin 223*a* is driven into the recessed portion forming slider 232. As illustrated in FIGS. 12A and 12B, the punch unit 300 is attached to a slide rack 208 by inserting the parallel pin 223*a* into a cam groove 208*a* formed on the slide rack 208. The slide rack 208 is moved by a slide rack moving motor M1 illustrated in FIG. 9 through a gear 214 in a thrust direction indicated by an arrow F illustrated in FIG. 12C.

Figure 12C:
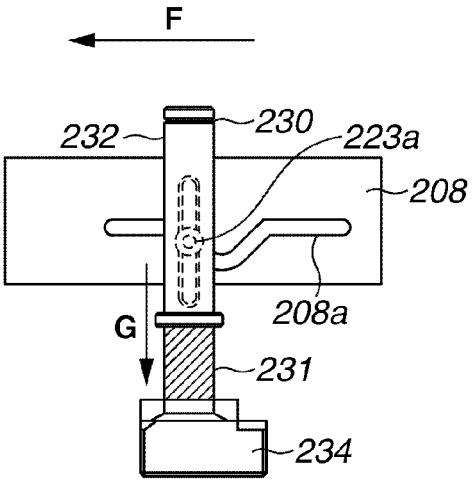

Such a movement of the slide rack 208 moves the parallel pin 223*a* in a direction indicated by an arrow G illustrated in FIG. 12C along a shape of the cam groove 208*a*. With this movement, the recessed portion forming slider 232 also moves in a recessed portion formation direction indicated by the arrow G. Herein, the movement of the recessed portion forming slider 232 applies a force in the direction G to the recessed portion formation pressing spring 231 which is in contact with the bottom of the recessed portion forming slider 232. Consequently, the recessed portion forming punch 230 is also moved in the direction G by receiving this force.

Figure 12D:
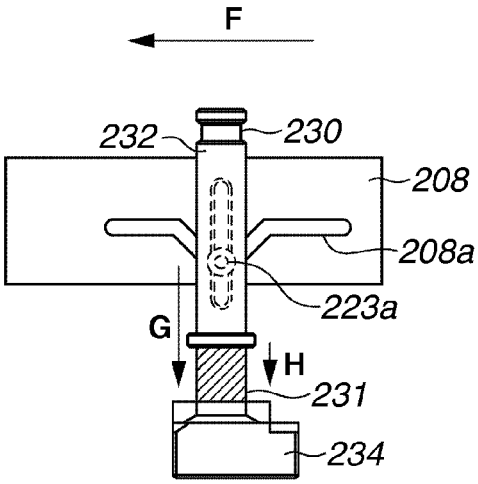

When the recessed portion forming punch 230 is moved in the direction G through the parallel pin 223*a*, the recessed portion forming punch 230 contacts the recessed portion forming die 234. Subsequently, as illustrated in FIG. 12D, the recessed portion forming slider 232 moves in the direction G along the shape of the slide rack 208. When the recessed portion forming slider 232 reaches the bottom dead position, the pressure of the recessed portion formation pressing spring 231 causes the sheet to be pinched by the recessed portion forming punch 230 and the recessed portion forming die 234, thereby forming a recessed portion recessed upward on a lower surface of the sheet. After the recessed portion is formed on the lower surface of the sheet, the slide rack 208 continues to move in a direction indicated by an arrow F in FIGS. 12C and 12D, and the parallel pin 223*a* guided by the slide rack 208 moves upward. With this movement, the recessed portion forming slider 232, the recessed portion formation pressing spring 231, and the recessed portion forming punch 230 move upward.

Next, an initial operation of the first recessed portion forming unit 201*a* of the recessed portion forming device 201 is described. The recessed portion forming device 201 includes a slide rack position detection sensor F2 illustrated in FIG. 16. The slide rack position detection sensor F2 is light-transmissive, and can detect a position of the slide rack 208. A finisher control unit 636 illustrated in FIG. 16 checks a state of the slide rack position detection sensor F2. Herein, if the slide rack position detection sensor F2 is OFF (transmissive), the slide rack 208 is moved in a direction opposite the direction F illustrated in FIGS. 12C and 12D. After the slide rack position detection sensor F2 is turned ON, the movement of the slide rack 208 stops in a predetermined amount. If the slide rack position detection sensor F2 is ON (oblique light), the slide rack 208 is once moved in the direction F. After the slide rack position detection sensor F2 is turned OFF, the slide rack 208 is moved in the opposite direction. After the slide rack position detection sensor F2 is turned ON, the movement of the slide rack 208 stops in a predetermined amount.

Since the slide rack moving motor M1 has an encoder on a motor shaft thereof, the finisher control unit 636 controls an amount of rotation of the slide rack moving motor M1, that is, an amount of movement of the slide rack 208, based on a signal from the encoder. Such control enables the punch unit 300 to receive the sheet S while the punch unit 300 is on standby above the recessed portion forming die 234 as illustrated in FIG. 12A. The initial operation of the second recessed portion forming unit 201*b* of the recessed portion forming device 201 is performed by driving a slide rack moving motor M2 according to a state of a slide rack position detection sensor F3 illustrated in FIG. 15.

Next, conveyance of the sheet to the recessed portion forming device 201 and a position assurance operation are described with reference to FIGS. 13A, 13B, 13C, and 13D. A trailing edge stopper 221 is used to maintain a certain distance from a trailing edge of the sheet to the punch unit 300 by abutting the trailing edge of the sheet thereto. When the sheet S is inserted from a direction indicated by an arrow I illustrated in FIG. 13A, a leading edge of the sheet S first presses the trailing edge stopper 221. Then, the sheet reaches the shift unit 401 while the trailing edge stopper 221 is rotated around a fulcrum 224 in a direction indicated by an arrow J illustrated in FIG. 13B.

Figure 13A:
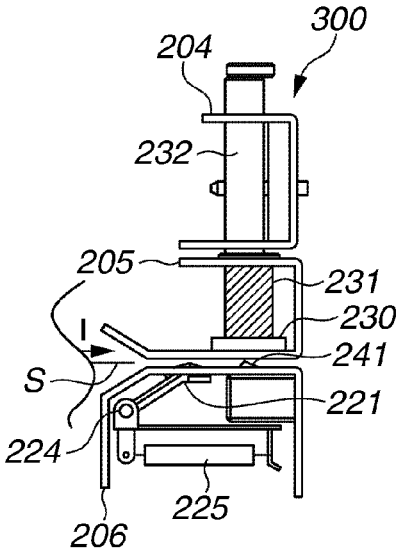
FIGS. 13A, 13B, 13C, and 13D are diagrams illustrating conveyance of a sheet to the recessed portion forming unit and a position assurance operation.
Figure 13B:
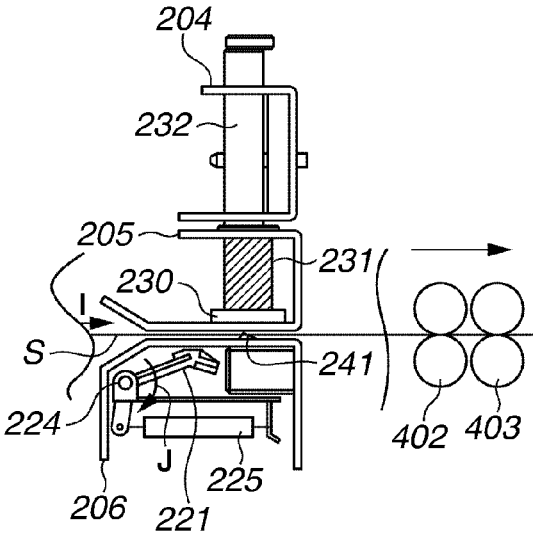
Figure 13C:
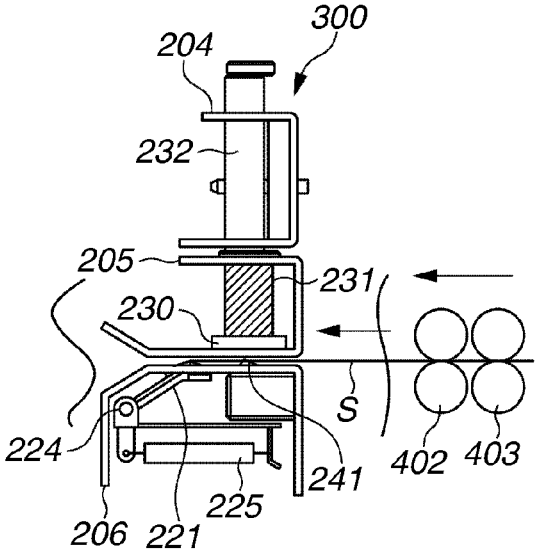
Figure 13D:
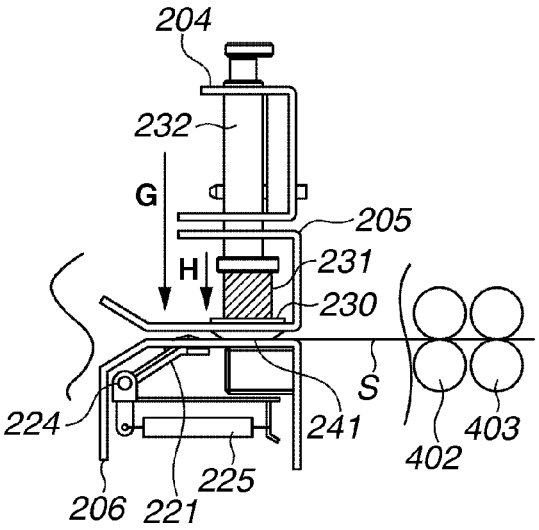

The shift unit 401 moves to a predetermined thrust position so that the position of the sheet S matches the recessed portion forming position according to the lateral registration error X detected by the lateral registration detection sensor 104 during the sheet conveyance. Subsequently, when the trailing edge of the sheet S passes through the trailing edge stopper 221, the trailing edge stopper 221 is returned to the original position by a spring 225. Then, the sheet S is switched back by the shift roller pairs 402 and 403. Therefore, as illustrated in FIG. 13C, the sheet S abuts the trailing edge stopper 221, and the recessed portion forming position from the trailing edge of the sheet S is determined.

The conveyance position of the sheet S is controlled based on the ON timing of a sheet presence sensor F1 provided in the shift unit 401 and a subsequent predetermined feeding amount of the sheet S according to sheet size. The sheet presence sensor F1 is described below with reference to FIG. 16. Accordingly, the sheet S is conveyed to a position in which the trailing edge thereof passes through the trailing edge stopper 221, and then is switched back by a predetermined amount. This operation can properly feed the sheet S to the trailing edge stopper 221. Subsequently, as illustrated in FIG. 12D, the punch unit 300 is driven, and a recessed portion is formed on the sheet S. After the recessed portion is formed on the lower surface of the sheet S, the shift roller pairs 402 and 403 rotate again in a normal rotating direction to convey the sheet S again.

Figure 14A:
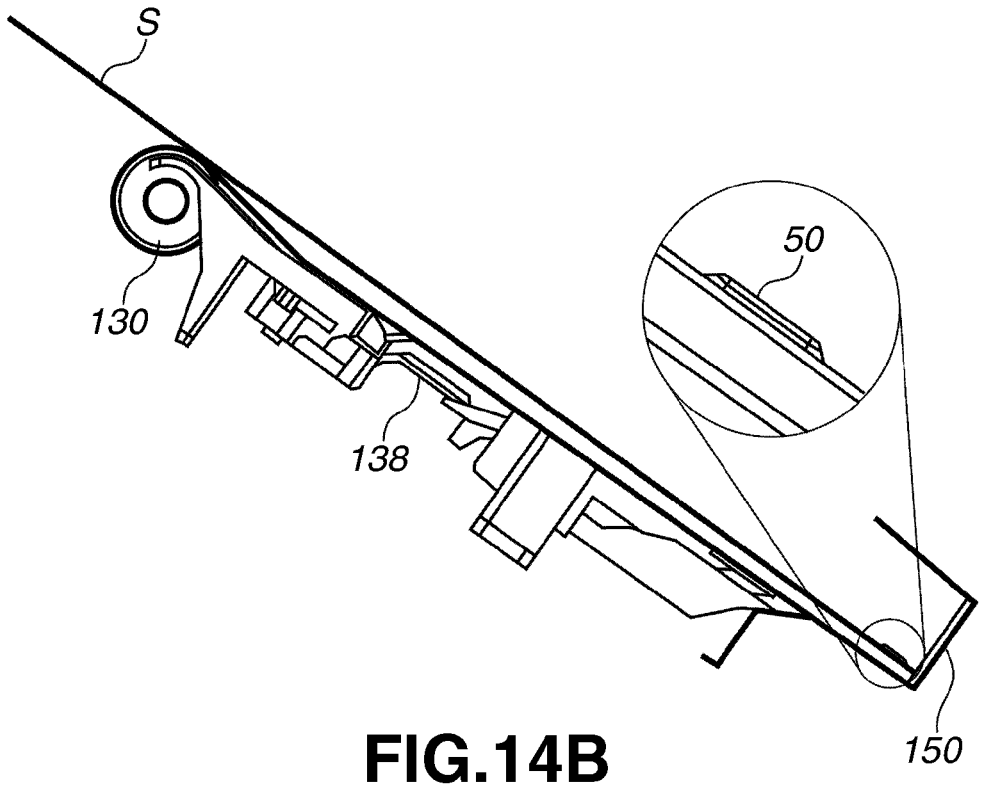
FIGS. 14A and 14B are diagrams illustrating a sheet on which a recessed portion is formed by the recessed portion forming device.
Figure 14B:
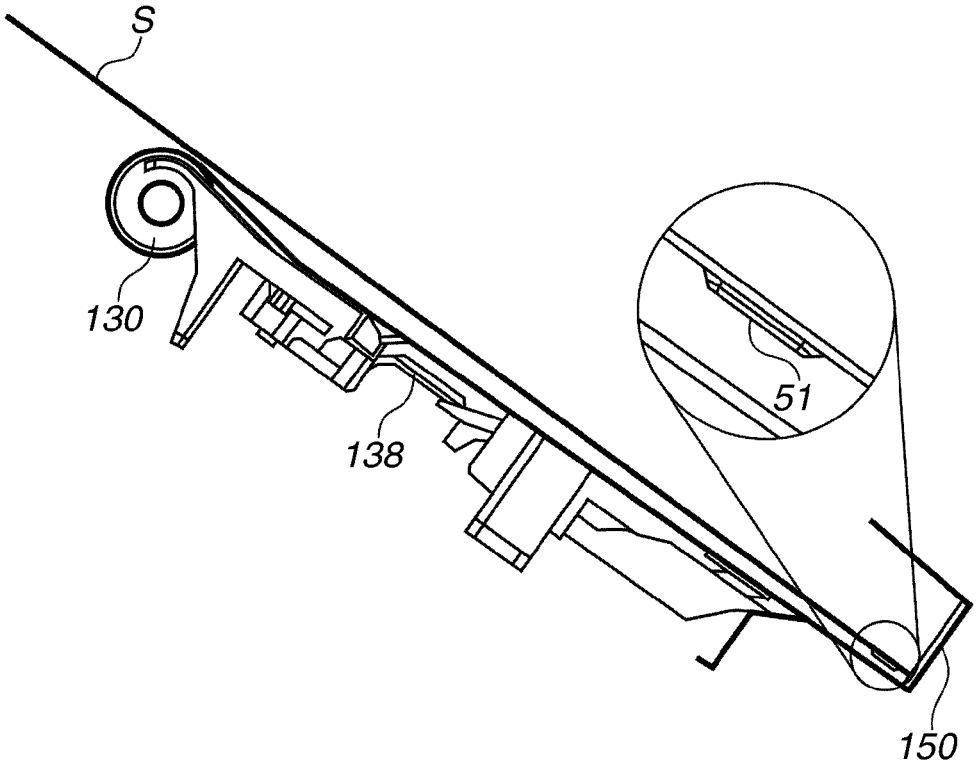

FIG. 14A illustrates a sheet S discharged on the intermediate processing tray 138 after a recessed portion 50 is formed on a lower surface of the sheet S by the first recessed portion forming unit 201*a*. FIG. 14B illustrates a sheet S discharged on the intermediate processing tray 138 after a recessed portion 51 is formed on an upper surface of the sheet S by the second recessed portion forming unit 201*b* as similar to the control performed by the first recessed portion forming unit 201*a*. As described referring to FIG. 8, the second recessed portion forming unit 201*b* is positioned on a downstream side in the sheet conveyance direction from the first recessed portion forming unit 201*a* with a predetermined distance. Thus, when the second recessed portion forming unit 201*b* forms the recessed portion 51 on the upper surface of the sheet S, the sheet S needs to abut the trailing edge stopper 221 as illustrated in FIG. 13C, and then be conveyed for a predetermined distance toward a direction of the second recessed portion forming unit 201*b*.

Figure 18A:
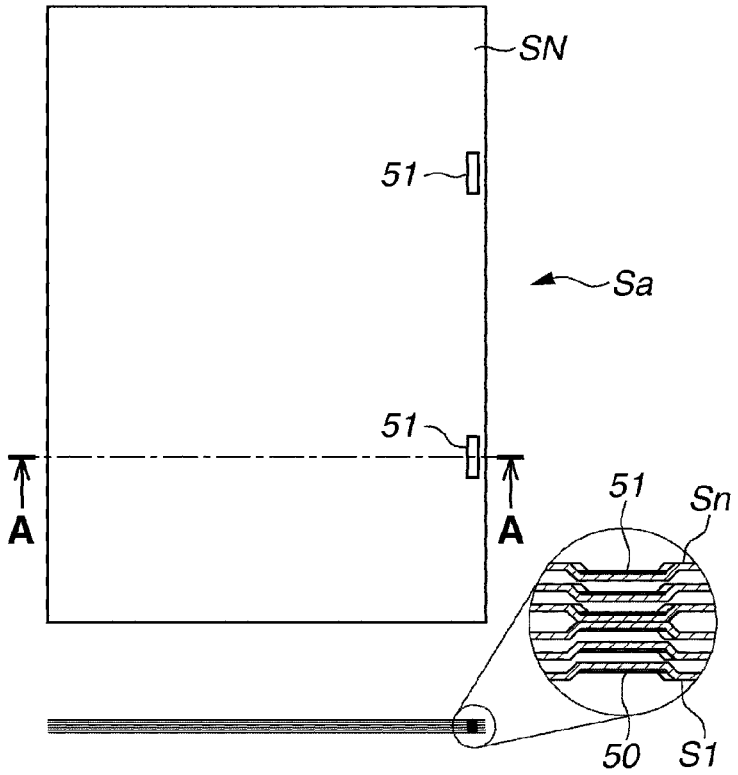
FIGS. 18A and 18B are diagrams illustrating before and after a staple is driven into sheets.
Figure 18B:
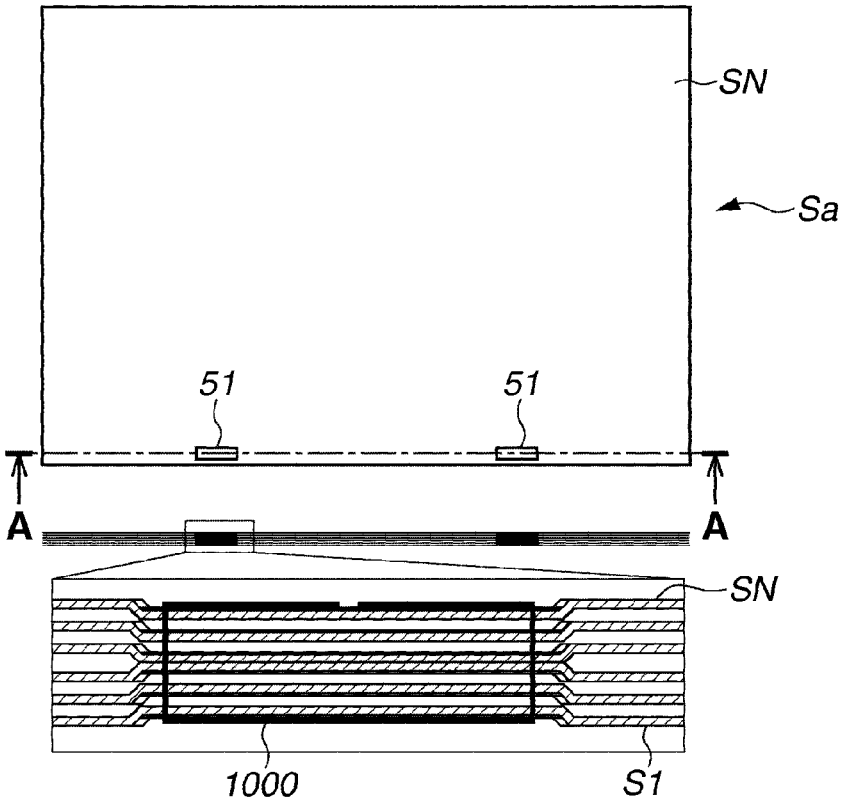

In the present exemplary embodiment, each of the recessed portions 50 and 51 is formed in a binding processing portion in which a staple is driven. As illustrated in FIGS. 18A and 18B, a depth of each of the recessed portions 50 and 51 is formed in such a manner that the staple 1000 does not project outward from a sheet surface, and a width-direction length of each of the recessed portions 50 and 51 is slightly longer than that of the staple 1000.

Figure 15:
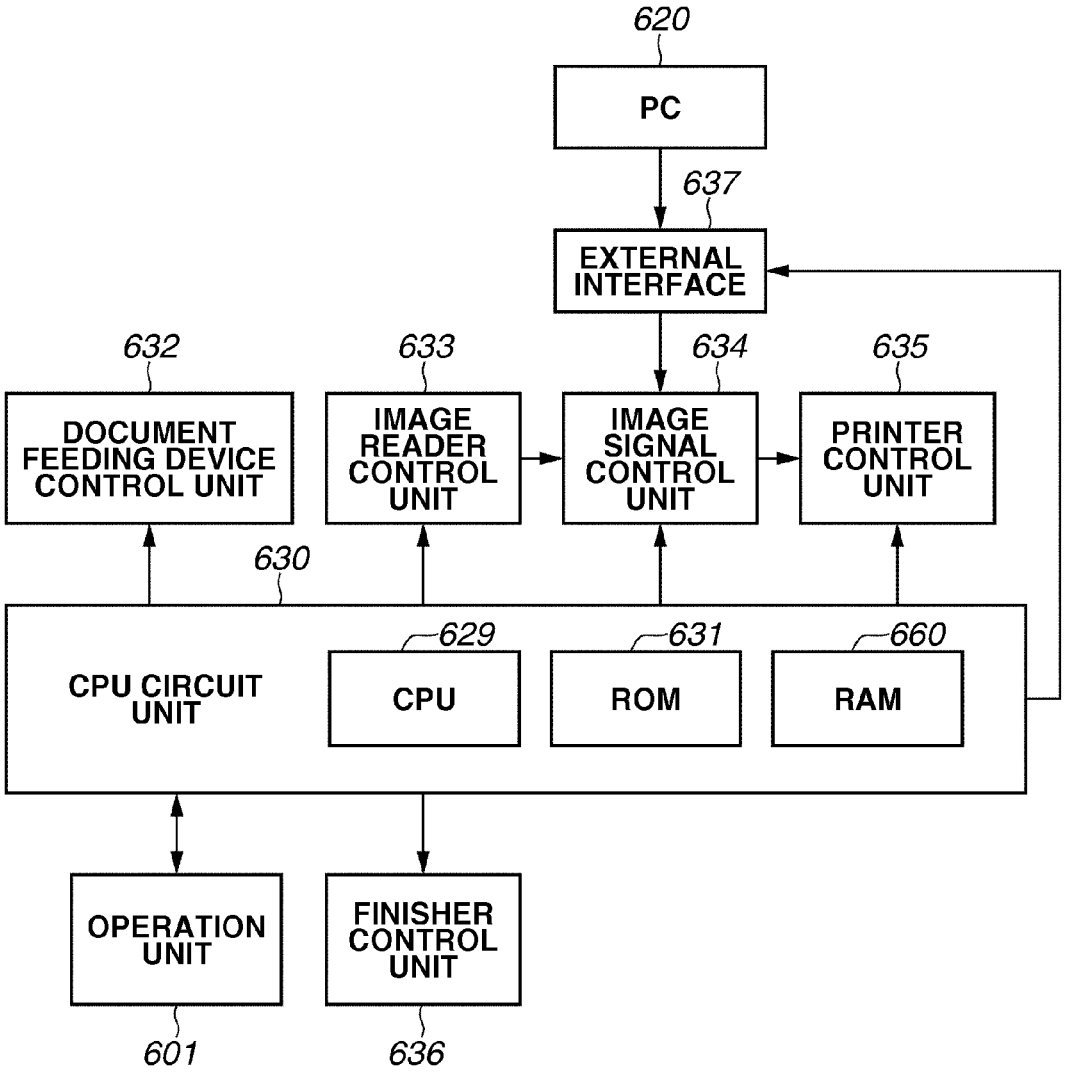
FIG. 15 is a control block diagram of the monochrome/color copying machine.

FIG. 15 is a control block diagram of the monochrome/color copying machine 600. The CPU circuit unit 630 includes a CPU 629, a read only memory (ROM) 631 storing control programs, and a random access memory (RAM) 660 used as an area for temporarily retaining control data and a work area for calculation for control operations. In FIG. 15, an external interface 637 is an interface between the monochrome/color copying machine 600 and an external personal computer (PC) 620. Upon receipt of print data from the external PC 620, the external interface 637 rasterizes the data into a bit map image and outputs the bit map image to an image signal control unit 634 as image data.

The image signal control unit 634 outputs the image data to a printer control unit 635, and the printer control unit 635 outputs the data received from the image signal control unit 634 to an exposure control unit (not illustrated). Herein, the image reader control unit 633 outputs an image of the document read by the image sensor 650*a* (see FIG. 1) to the image signal control unit 634, and the image signal control unit 634 outputs this image to the printer control unit 635.

Moreover, the operation unit 601 includes a plurality of keys used by a user to set various functions relating to image formation, and a display unit for displaying a setting state. The operation unit 601 outputs a key signal corresponding to each key operated by the user to the CPU circuit unit 630, and displays information on the display unit based on the signal from the CPU circuit unit 630.

The CPU circuit unit 630 controls the image signal control unit 634 according to the control program stored in the ROM 631 and the setting provided from the operation unit 601, and controls the document conveyance apparatus 651 (see FIG. 1) through a document feeding device control unit 632. Moreover, the CPU circuit unit 630 controls the document reading unit 650 (see FIG. 1), the image forming unit 603 (see FIG. 1), and the finisher 100 through the image reader control unit 633, the printer control unit 635, and the finisher control unit 636, respectively.

In the present exemplary embodiment, the finisher control unit 636 is installed in the finisher 100, and controls a drive of the finisher 100 by exchanging information with the CPU circuit unit 630. The finisher control unit 636 and the CPU circuit unit 630 may be integrally disposed in the copying machine main body 602, so that the finisher 100 can be controlled directly from the copying machine main body 602.

Figure 16:
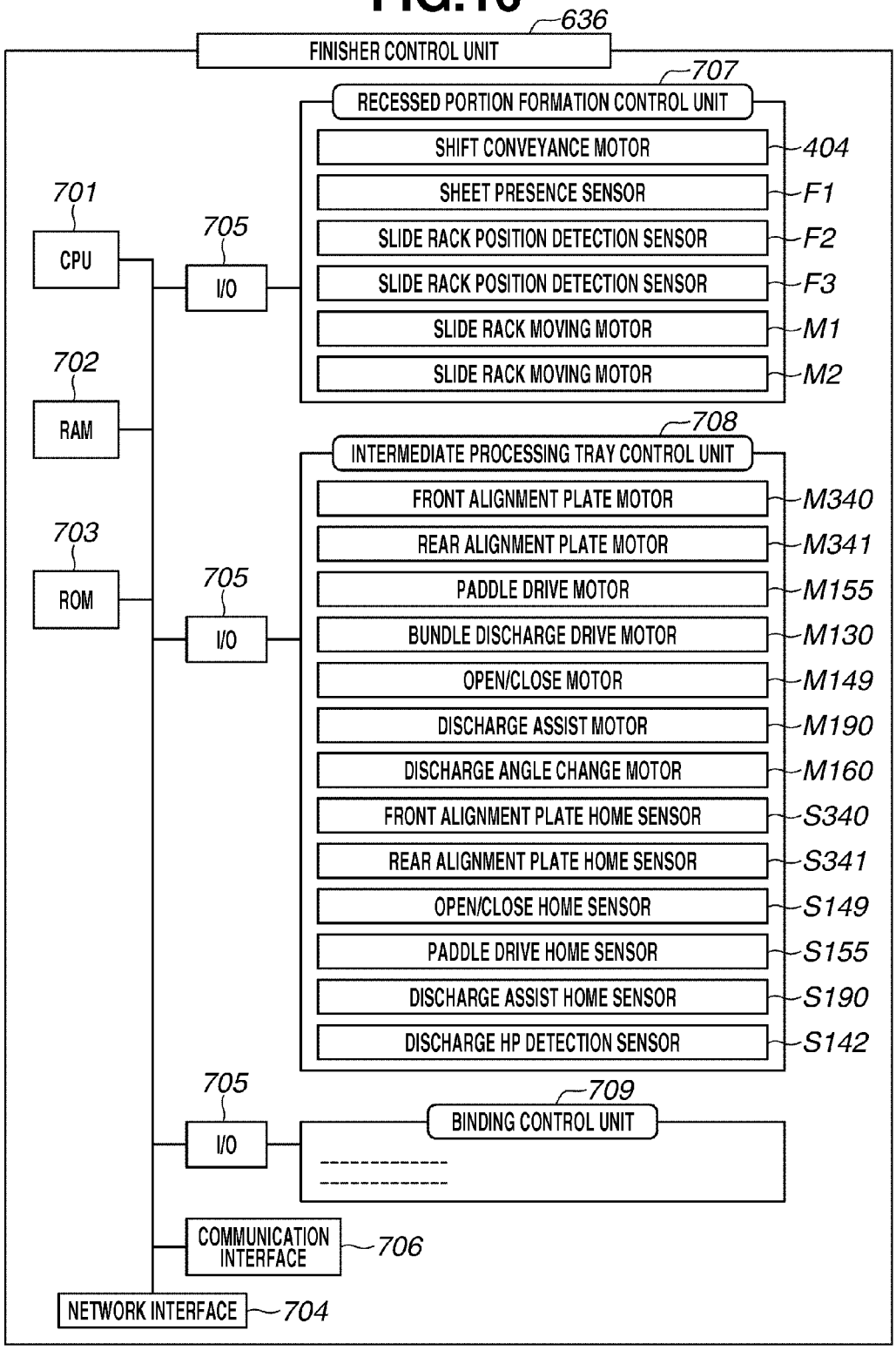
FIG. 16 is a control block diagram of the finisher.

FIG. 16 is a control block diagram of the finisher 100 according to the present exemplary embodiment. The finisher control unit 636 includes a CPU (microcomputer) 701, a RAM 702, a ROM 703, an input/output unit (I/O) 705, a communication interface 706, and a network interface 704. The input/output unit 705 is connected to a recessed portion formation control unit 707, an intermediate processing tray control unit 708, and a binding control unit 709. The recessed portion formation control unit 707 controls the shift conveyance motor 404 and the slide rack moving motors M1 and M2 based on signals from the sheet presence sensor F1 and the slide rack position detection sensors F2 and F3 to form a recessed portion on a sheet.

The intermediate processing tray control unit 708 is connected to a front alignment plate home sensor 5340, a rear alignment plate home sensor 5341, an open/close home sensor 5149, a paddle drive home sensor 5155, a discharge assist home sensor 5190, and a discharge HP detection sensor 5142. Moreover, the intermediate processing tray control unit 708 is connected to a front alignment plate M340, a rear alignment plate motor M341, a paddle drive motor M155, a bundle discharge drive motor M130, an open/close motor M149, and a discharge assist motor M190.

The intermediate processing tray control unit 708 controls operations of the front and rear alignment plates 340 and 341, an operation of the pull-in puddle 131, a movement operation of the belt roller 158, and an open/close operation of the opening/closing guide 149 using the respective home position sensors and the moving motors. The binding control unit 709 controls drives of a clinch motor and a stapler moving motor (not illustrated), and is connected to the stapler home sensor 5303.

Figure 17:
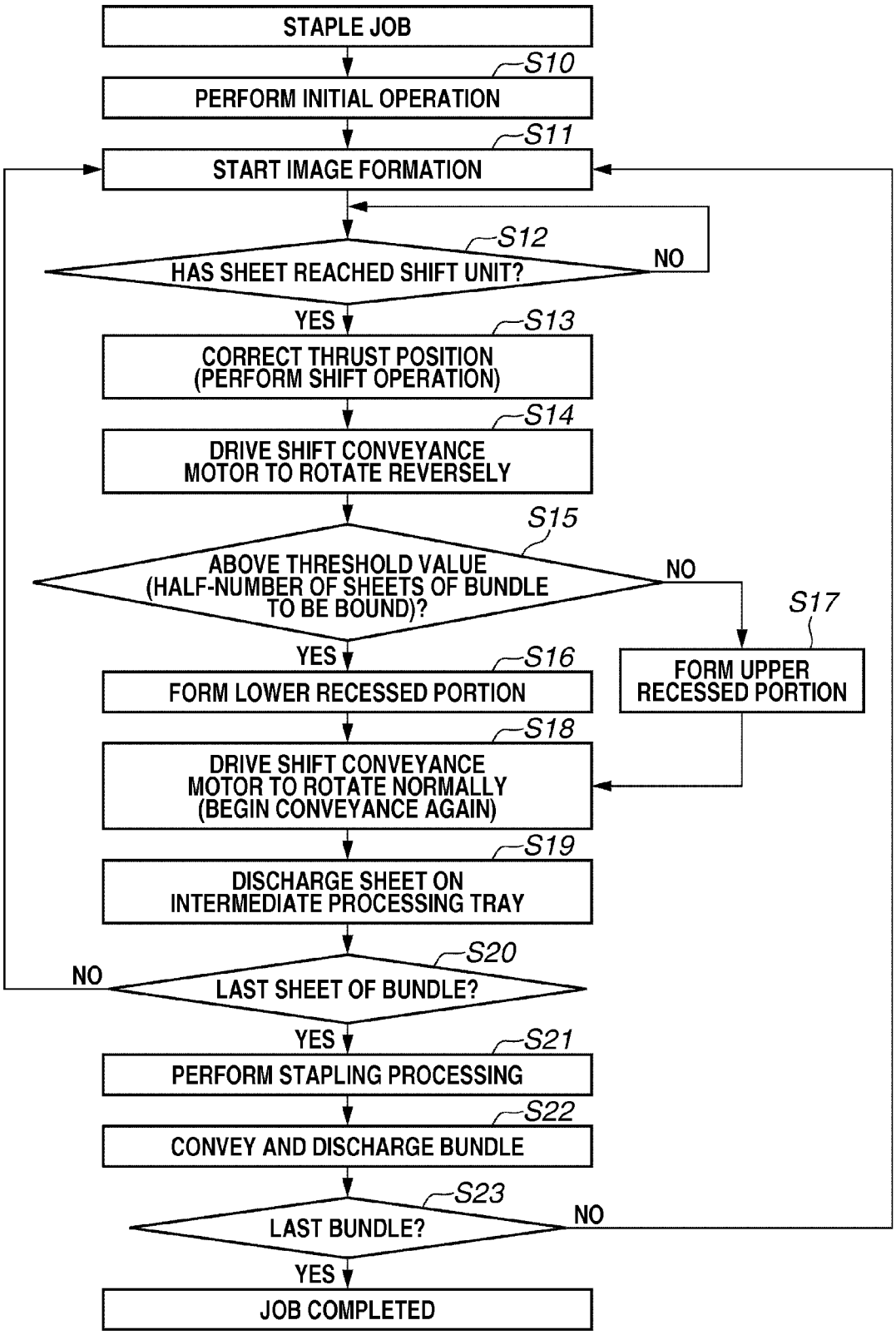
FIG. 17 is a flowchart illustrating an operation in a staple-sort job performed by the finisher.

Next, a staple-sort job operation performed by the finisher 100 configured as described above is described with reference to a flowchart illustrated in FIG. 17.

In step S10, when a user selects a staple job, the above described initial operation of the recessed portion forming device 201 is performed. In step S11, the copying machine main body 602 starts image formation on a sheet. In step S12, the image-formed sheet is transferred from the copying machine main body 602 to the finisher 100, and the finisher 100 determines whether the sheet has reached the shift unit 401. If the sheet has reached the shift unit 401 (YES in step S12), then in step S13, the shift unit 401 corrects a thrust position of the sheet (shift operation). Accordingly, a lateral position of the sheet is corrected.

In step S14, the finisher control unit 636 drives the shift conveyance motor 404 to rotate reversely. This reverse rotation of the shift conveyance motor 404 not only cause the sheet to be switched back by the shift roller pairs 402 and 403 and conveyed to the recessed portion forming device 201, but also assures a recessed portion forming position on the sheet. In step S15, the finisher 100, based on the number of sheets to be bound in a bundle and information about what number-Nth sheet in the bundle this conveyed sheet is, performs processing for determining a direction in which a recessed portion is formed. In other words, in step S15, the finisher 100 determines whether the conveyed sheet is above a threshold value (the half-number of sheets of the bundle to be bound).

Herein, a first sheet of the job is below the threshold value (NO in step S15), then in step S17, the finisher control unit 636 drives the slide rack moving motor M1 of the first recessed portion forming unit 201*a* to move the slide rack 208. This moves down the punch unit 300 to form the recessed portion 50 recessed upward on a lower surface of the first sheet as illustrated in FIG. 14A. Hereinafter, the recessed portion 50 is called an upper recessed portion 50.

In the present exemplary embodiment, if the number of sheets in a bundle to be bound is an even number (the N number of sheets), the upper recessed portions 50 are formed on the sheets from a first sheet to an N/2-th sheet. Meanwhile, the recessed portions 51 each recessed downward on an upper surface of the sheet as illustrated in FIG. 14B are formed on an N/2+1-th sheet through an Nth sheet. The recessed portion 51 is hereinafter called a lower recessed portion 51. On the other hand, if the number of sheets in a bundle to be bound is an odd number (the N number of sheets), the upper recessed portions 50 are formed on the sheets from a first sheet to an (N−1)/2-th sheet. Meanwhile, the lower recessed portions 51 are formed on an (N−1)/2+1-th sheet through an Nth sheet. Thus, the lower recessed portion 51 is formed on an upper-half of the sheet bundle to be bound, whereas the upper recessed portion 50 is formed on a lower-half of the sheet bundle to be bound.

In step S18, after the upper recessed portion 50 is formed on the lower surface of the first sheet, the finisher control unit 636 drives the shift conveyance motor 404 to rotate in a normal direction to start re-conveying the sheet by the shift roller pairs 402 and 403. In step S19, the sheet is discharged to the intermediate processing tray 138. The sheet discharged on the intermediate processing tray 138 is transferred to the belt roller 158 by the pull-in puddles 131, and a trailing edge of the sheet is abutted on an abutting surface of the trailing edge stoppers 150 by the belt roller 158. Thus, the conveyance direction of the sheet is aligned.

After the conveyance direction of the first sheet is aligned, a width direction of the first sheet is aligned by the front and rear alignment plates 340 and 341 as an alignment member pair. Subsequently, a second sheet of the first bundle is transferred to the finisher 100. The second sheet undergoes correction of a lateral position thereof, switchback conveyance, formation of an upper recessed portion, and re-conveyance before being discharged to the intermediate processing tray 138. Herein, the second sheet is pulled toward the trailing edge stoppers 150 by the belt roller 158, so that the second sheet abuts the trailing edge stoppers 150 by moving over the upper recessed portion 50 of the first sheet. Consequently, the second sheet is aligned in a state where the upper recessed portion thereof overlaps with that of the first sheet. After the trailing edge of the second sheet is aligned, a width direction of the second sheet is aligned by the front and rear alignment plates 340 and 341 as similar to that of the first sheet. Thereafter, sheets with upper recessed portions are successively conveyed to the intermediate processing tray 138, and both the discharge direction and the width direction thereof are successively aligned.

Then, for example, in a case where the number of sheets in a bundle to be bound is an even number, an N/2+1-th sheet is to be conveyed. In this case, that is, if the sheet to be conveyed is the threshold value or greater (YES in step S15), the finisher control unit 636 drives the slide rack moving motor M2 of the second recessed portion forming unit 201*b* to move the slide rack 208. In step S16, the movement of the slide rack 208 moves up the punch unit 300, illustrated in FIGS. 9A and 9B, to form a lower recessed portion 51 on the N/2+1-th sheet, the lower recessed portion 51 that is recessed in a direction opposite the upper recessed portion 50.

In step S18, the finisher control unit 636 drives the shift conveyance motor 404 to rotate in a normal direction to start re-conveying the sheet by the shift roller pairs 402 and 403. In step S19, the sheet is discharged to the intermediate processing tray 138. The sheet discharged on the intermediate processing tray 138 is transferred to the belt roller 158 by the pull-in puddles 131, and a trailing edge of the sheet is abutted on the abutting surface of the trailing edge stoppers 150 by the belt roller 158. Thus, the conveyance direction of the sheet is aligned. Herein, the sheet has the lower recessed portion 51 thereon. However, the sheet is pulled toward the trailing edge stoppers 150 by the belt roller 158, and abuts the trailing edge stoppers 150 by moving over the already stacked sheets. Consequently, the N/2+1-th sheet is aligned in a state where the lower recessed portion 51 thereof overlaps with the upper recessed portion 50 of the N/2-th sheet.

After the conveyance direction of the sheet is aligned, a width direction of the sheet is aligned by the front and rear alignment plates 340 and 341. Subsequently, an N/2+2-th sheet is also transferred to the finisher 100. The N/2+2-th sheet undergoes correction of a lateral position thereof, switchback conveyance, formation of a lower recessed portion, and re-conveyance before being discharged to the intermediate processing tray 138. Next, the N/2+2-th sheet is further pulled toward the trailing edge stoppers 150 by the belt roller 158, and abuts the abutting surface of the trailing edge stoppers 150, so that the sheet is aligned. After the trailing edge of the sheet is aligned, a width direction of the sheet is aligned by the front and rear alignment plates 340 and 341. Therefore, sheets with lower recessed portions are successively conveyed to the intermediate processing tray 138, and both the discharge direction and the width direction thereof are successively aligned.

Such a series of operations is repeated until a last sheet of the first bundle, that is, the last sheet within the bundle, abuts the trailing edge stoppers 150. In step S20, the finisher 100 determines whether the aligned sheet is a last sheet of the bundle. If the aligned sheet is determined as the last sheet of the bundle (YES in step S20), then in step S21, the stapler 132 performs stapling processing by driving the staple 1000 in the recessed portion formed on the trailing edge of the sheet bundle. FIG. 18A illustrates a state of a sheet bundle Sa when a last sheet SN of the sheet bundle Sa is aligned. Herein, the lower recessed portion 51 is formed on an upper-half of the sheet bundle Sa, and the upper recessed portion 50 is formed on a lower-half of the sheet bundle Sa.

FIG. 18B illustrates a state of the sheet bundle Sa when the stapler 132 performs stapling processing by driving the staple 1000 in the recessed portions 50 and 51 formed on the trailing end edge of the sheet bundle Sa. In the present exemplary embodiment, since the stapler 132 drives the staple 1000 into the sheet bundle Sa from underneath, the staple 1000 is driven into the upper recessed portion 50, and both ends thereof are folded on the lower recessed portion 51. At that time, since the depth of the recessed portions 50 and 51 is designed so that the staple 1000 does not project outward from a surface of the sheet bundle as described above, the staple 1000 does not project outward from surfaces of a first sheet S1 and an Nth sheet SN.

Figure 19:
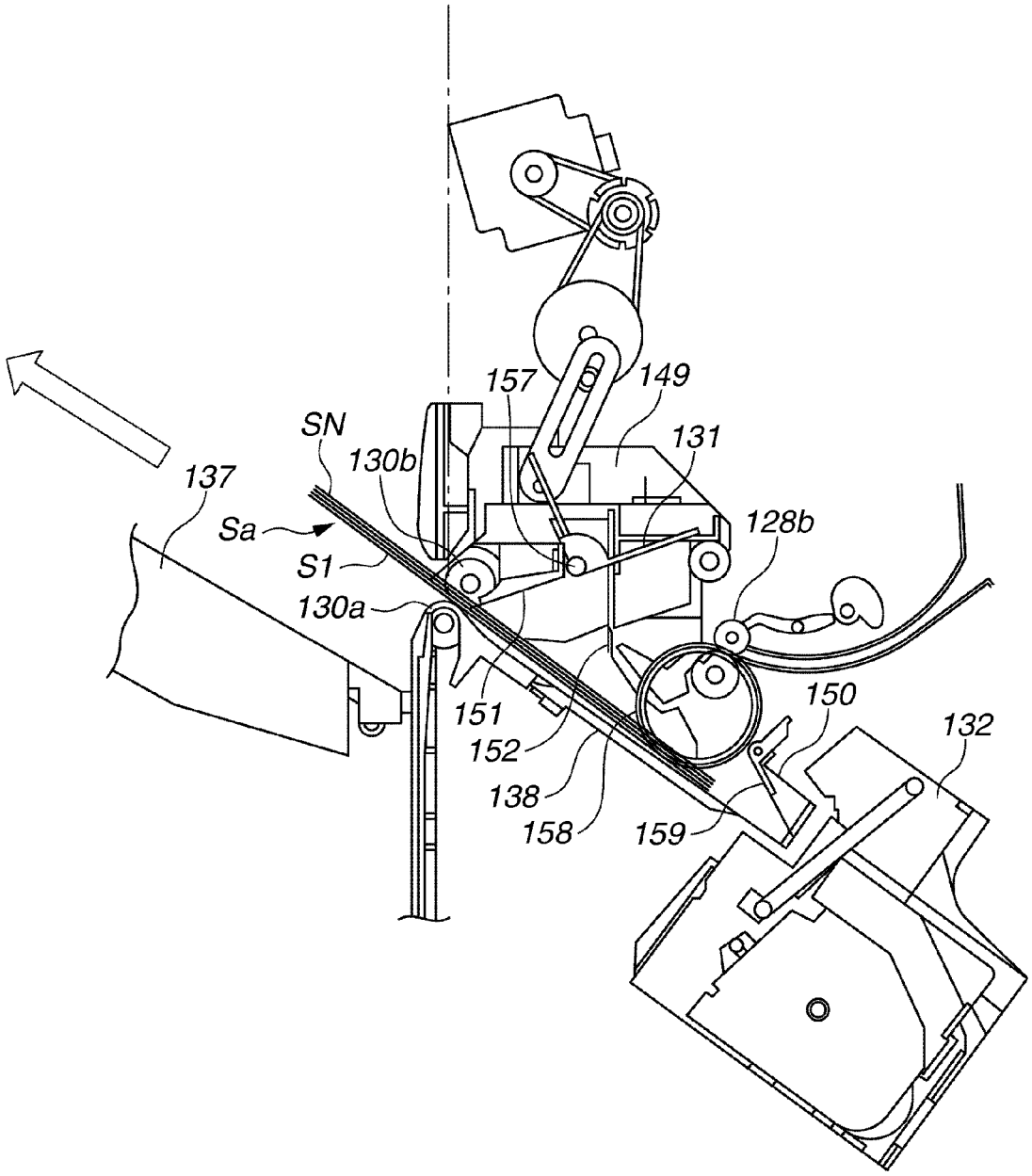
FIG. 19 is a diagram illustrating an operation for discharging a stapled sheet bundle.

After the stapling processing is performed on the trailing end portion of the sheet bundle Sa, the operation proceeds to step S22. In step S22, when receiving the sheet bundle Sa, as illustrated in FIG. 19, the finisher control unit 636 causes the opening/closing guide 149 having swung upward to move downward to pinch the sheet bundle Sa with the bundle discharge roller pair 130. The sheet bundle Sa pinched between the bundle discharge roller pair 130 is conveyed in a direction indicated by an arrow illustrated in FIG. 19, and discharged to the lower discharge tray 137. If the discharged sheet bundle Sa is not a last bundle (NO in step S23), the operations from step S11 to step S22 is repeated. If the discharged bundle Sa is the last bundle (YES in step S23), the staple job is completed.

Figure 20A:
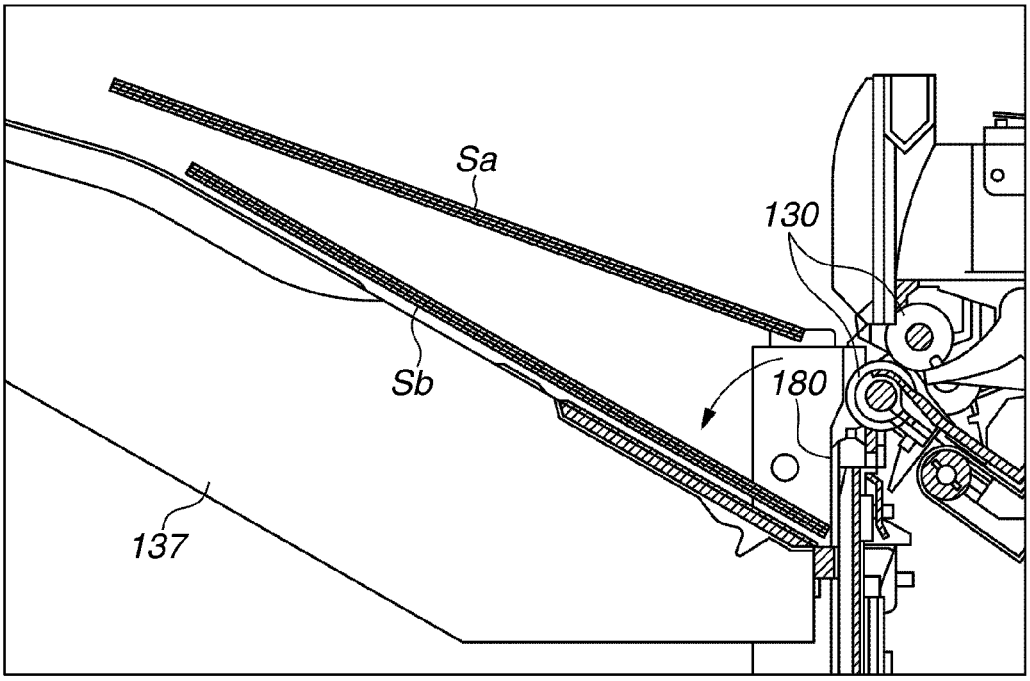
FIGS. 20A and 20B are first diagrams illustrating an operation performed after the stapled sheet bundle is discharged.
Figure 20B:
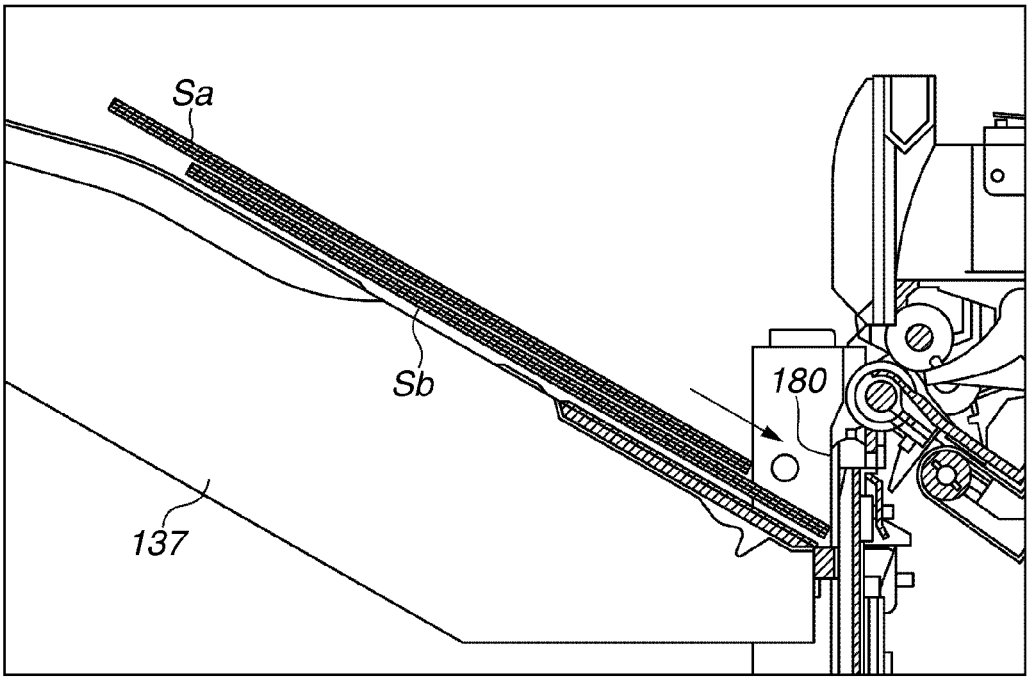

In the present exemplary embodiment, after the stapling processing, the sheet bundle Sa passes through a nip between the bundle discharge roller pair 130 and falls to the lower discharge tray 137 with a weight thereof as illustrated in FIG. 20A. At this time, since there is a sheet bundle Sb already discharged and stacked on the lower discharge tray 137, the sheet bundle Sa falls on the already stacked sheet bundle Sb. Then, the sheet bundle Sa starts to slide toward a stack wall 180 since the lower discharge tray 137 is inclined as illustrated in FIG. 20B.

Figure 21:
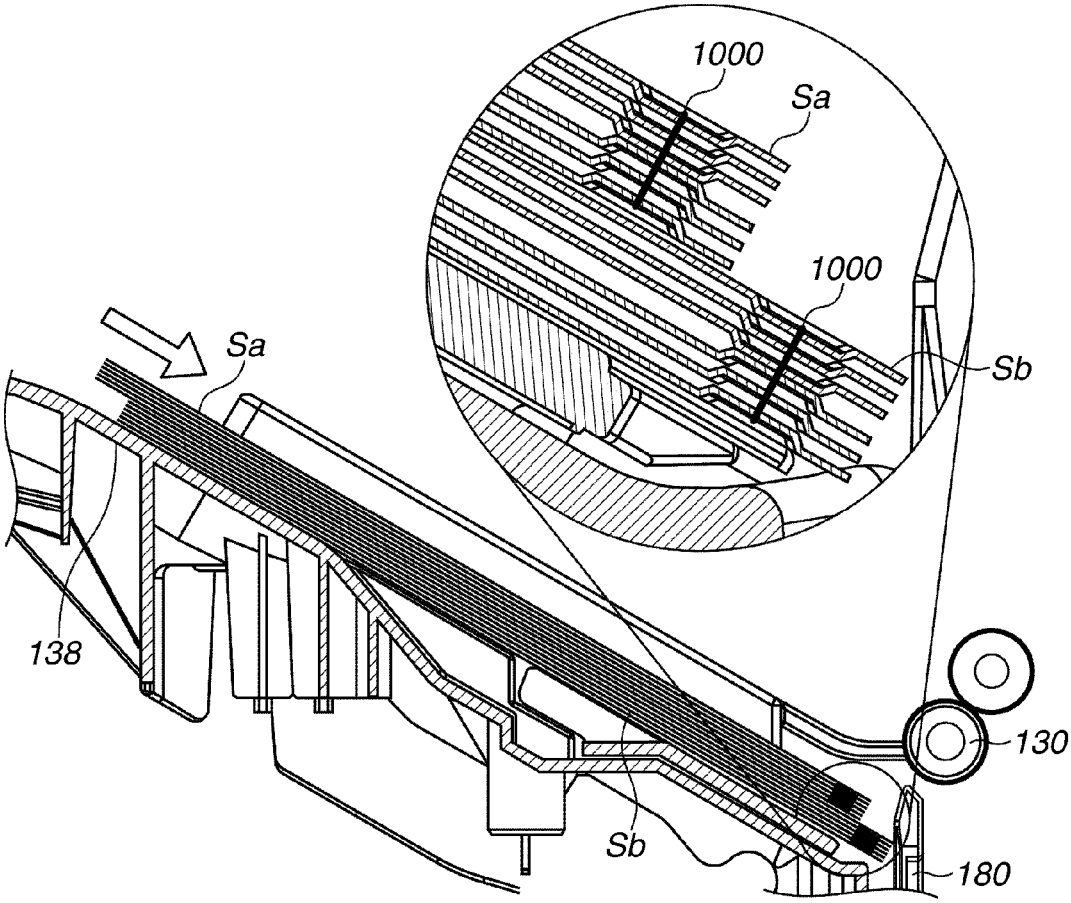
FIG. 21 is a second diagram illustrating an operation performed after the stapled sheet bundle is discharged.

Herein, the already stacked sheet bundle Sb is also stapled with a staple 1000. As illustrated in FIG. 21, the staple 1000 of the already stacked sheet bundle Sb does not project from an upper surface as a surface to contact the sheet bundle Sa to be stacked next on the lower discharge tray 137. In addition, the staple 1000 of the next sheet bundle Sa does not project from a lower surface as a surface to contact the already stacked sheet bundle Sb.

Therefore, the sheet bundle Sa slides toward the stack wall 180 without catching on the staple 1000 of the already stacked sheet bundle Sb. The slide of the sheet bundle Sa stops in a state where the sheet bundle Sa abuts the stack wall 180. This stack wall 180 vertically extends from a trailing edge portion of the lower discharge tray 137. When the sheet bundle Sa contacts the stack wall 180, the trailing edge positions of the sheet bundles Sa and Sb are regulated. Accordingly, the formation of the recessed portions 50 and 51 on the sheets S enables the sheet bundle Sa to be stacked on the already stacked sheet bundle Sb without a situation where a trailing edge and the staple 1000 of the next sheet bundle Sa catches on the staple 1000 of the already stacked sheet bundle Sb.

Therefore, the recessed portions 50 and 51 are formed on the sheet bundles Sa and Sb so that the staple 1000 does not project from each of the sheet bundles Sa and Sb. Such formation of the recessed portions 50 and 51 does not cause an edge and the staple 1000 of the next sheet bundle Sa to interfere with the staple 1000 of the already stacked sheet bundle Sb. Consequently, this can prevent deteriorations in stackability of sheet bundles on the stack tray, and enables the sheet bundles to be stacked with good alignment. Moreover, since the interference of the edge and the staple 1000 of the next sheet bundle Sa with the staple 1000 of the already stacked sheet bundle Sb can be prevented, a curl and a fold of the sheet edge can be prevented. Moreover, substantially same products can be generated.

In the present exemplary embodiment, therefore, the upper and lower recessed portions 50 and 51 are formed on each of the sheet bundles Sa and Sb, so that the next sheet bundle Sa is stacked without catching on a binding portion of the already stacked sheet bundle Sb. Thus, the sheet bundles Sa and Sb can be stacked without deteriorating alignment and quality thereof. More specifically, the staple 1000 is driven into the upper and lower recessed portions 50 and 51 formed in each sheet bundle, so that the next sheet bundle Sb is prevented from catching on the staple 1000 of the already stacked sheet bundle Sa, thereby stacking the sheet bundles without deterioration of alignment and quality thereof.

According to the present exemplary embodiment, in the recessed portion forming device 201, the first and second recessed portion forming units 201*a* and 201*b* having different recessed portion formation directions are arranged side by side. However, the exemplary embodiment is not limited thereto. For example, a plurality of recessed portion forming units may be arranged side by side in a width direction perpendicular to a sheet conveyance direction.

Figure 22A:
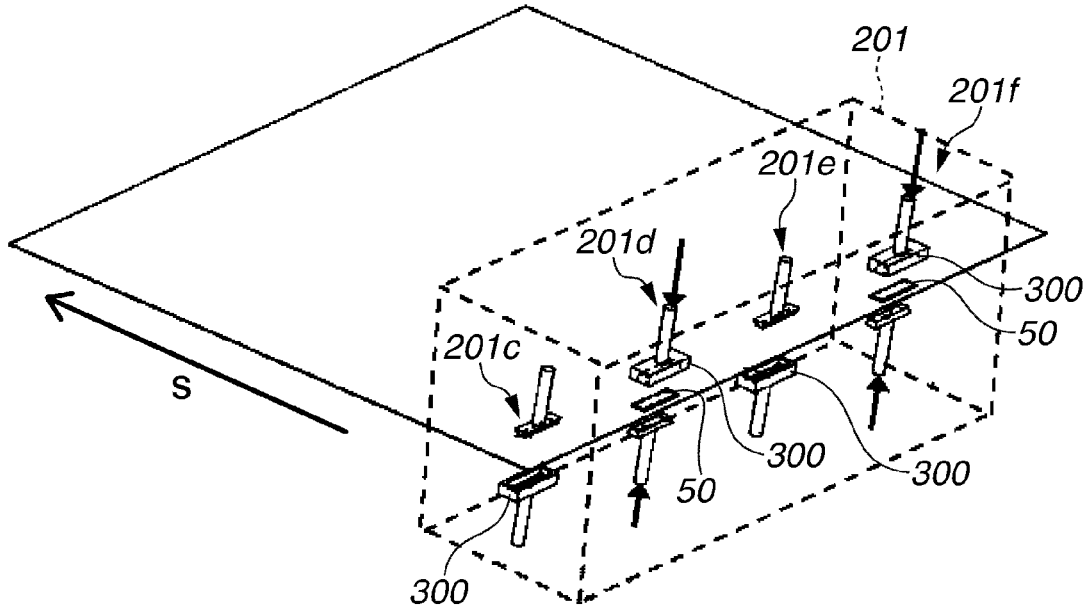
FIGS. 22A and 22B are diagrams illustrating a configuration of a recessed portion forming unit provided in a sheet processing apparatus according to a second exemplary embodiment.
Figure 22B:
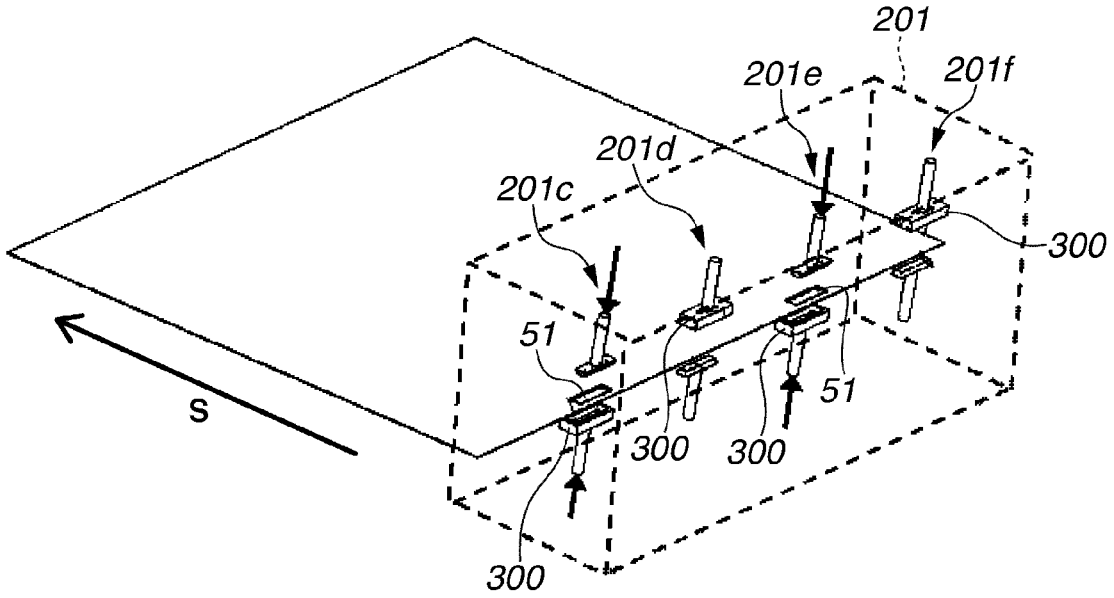
Figure 23:
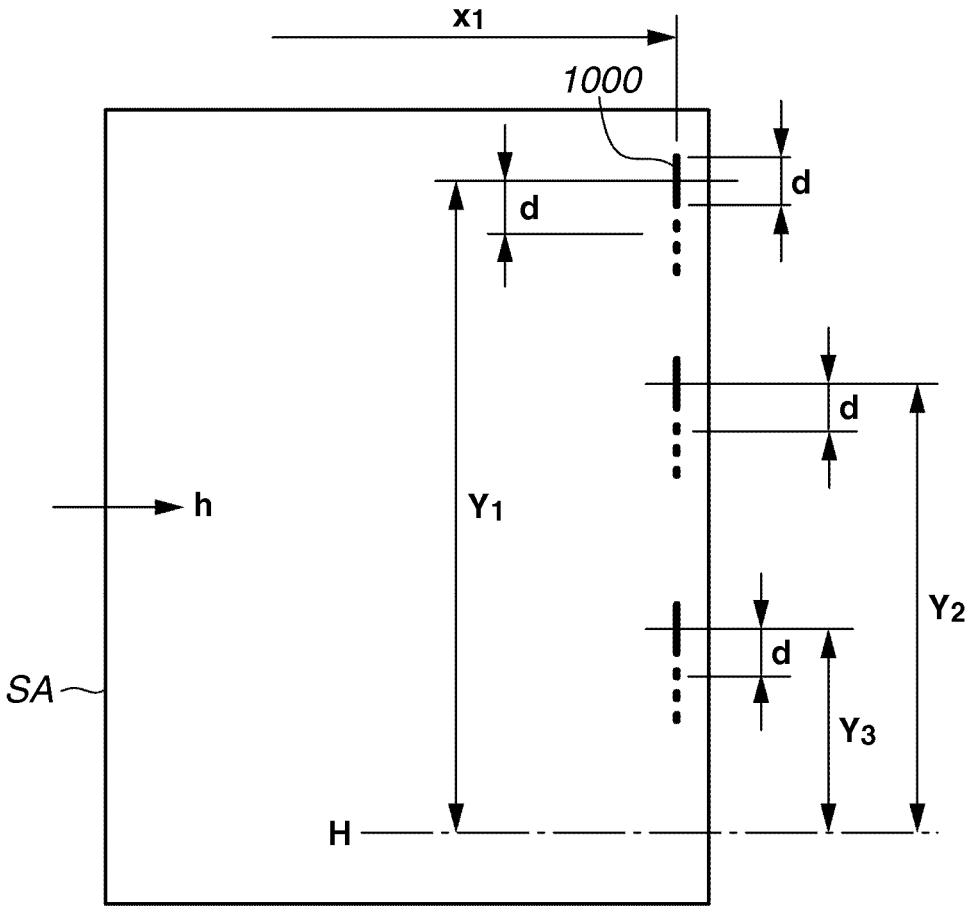
FIG. 23 is a diagram illustrating sheet bundle binding processing performed by a conventional sheet processing apparatus.

Next, a second exemplary embodiment is described. In the present exemplary embodiment, a plurality of recessed portion forming units is arranged side by side in a width direction. FIGS. 22A and 22B are diagrams illustrating a configuration of a recessed portion forming device 201 serving as a recessed portion forming unit provided in a sheet processing apparatus according to the present exemplary embodiment. As illustrated in FIGS. 22A and 22B, the recessed portion forming device 201 includes a punch unit 300, and four recessed portion forming units 201*c* through 201*f* arranged side by side in a width direction. Herein, each of the recessed portion forming units 201*c* and 201*e* forms a lower recessed portion, and each of the recessed portion forming units 201*d* and 201*f* forms an upper recessed portion.

In the present exemplary embodiment, a pitch distance between the recessed portion forming units 201*c* and 201*e* and a pitch distance between the recessed portion forming units 201*d* and 201*f* are substantially the same. Moreover, the recessed portion forming units 201*c* and 201*e* and the recessed portion forming units 201*d* and 201*f* can be independently driven.

For example, such a configuration enables upper recessed portions 50 to be formed on a first sheet through an (N−1)/2-th sheet of sheets S by the recessed portion forming units 201*d* and 201*f* as illustrated in FIG. 22A. In addition, lower recessed portions 51 can be formed on an (N−1)/2+1-th sheet through an N-th sheet among the sheets S by the recessed portion forming units 201*c* and 201*e* as illustrated in FIG. 22B by moving each of the sheets S in a width direction by the shift unit 401.

Therefore, in the present exemplary embodiment, the plurality of recessed portion forming units 201*c* through 201*f* is arranged side by side in the width direction. After the upper recessed portions 50 are formed by the recessed portion forming units 201*d* and 201*f*, the lower recessed portions 51 are formed by the recessed portion forming units 201*c* and 201*e*. Such a configuration can shorten a length of the recessed portion forming device 201 in a sheet conveyance direction.

Each of the exemplary embodiments has been described using a case where the recessed portion forming device 201 forms a recessed portion which is slightly longer than the staple 1000 in a predetermined position on a sheet edge, the recessed portion as illustrated in FIGS. 18A and 18B. However, exemplary embodiments of the present invention are not limited thereto. For example, the recessed portion forming device 201 may form a long recessed portion having a predetermined length extending in a sheet width direction on an edge of a sheet. The formation of such a long recessed portion enables the recessed portion forming device 201 to deal with changes in a binding pitch.

Moreover, each of the exemplary embodiments has been described using a case where a lower recessed portion is formed on an upper surface of each sheet in an upper-half of the sheet bundle, whereas an upper recessed portion is formed on a lower surface of each sheet in a lower-half of the sheet bundle. However, exemplary embodiments of the present invention are not limited thereto. A recessed portion having a predetermined depth may be formed in an area corresponding to a position in which a staple 1000 is driven from at least one of top and bottom surfaces of a sheet bundle. For example, if a staple 1000 is thin, a recessed portion can be formed only on a sheet having a surface opposite the side on which the staple 1000 is driven into a sheet bundle, that is, a surface on which the driven staple 1000 is folded. If a sheet is thick, a recessed portion can be formed only on a sheet having a surface of a side on which a staple 1000 is driven, and a sheet having a surface opposite the side on which the staple 1000 is driven among sheets in a sheet bundle. Alternatively, a recessed portion may be formed on several sheets among sheets in a sheet bundle.

In each of the exemplary embodiments, a plurality of recessed portion forming units is used to form two recessed portions. However, the exemplary embodiments of the present invention are not limited thereto. For example, even when one recessed portion forming unit is used, two recessed portions can be formed by moving a sheet in a width direction using the shift unit 401 subsequent to formation of one recessed portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-155356 filed Jul. 11, 2012, which is hereby incorporated by reference herein in its entirety.

What is claimed is:

1. A sheet processing apparatus comprising:

a processing tray on which sheets to be processed are sequentially conveyed and stacked;

a binding unit configured to bind a sheet bundle stacked on the processing tray by driving a binding member into the sheet bundle;

a sheet bundle stacking unit configured to sequentially stack the plurality of the sheet bundles each bound by the binding unit; and a recessed portion forming unit configured to form a first recessed portion in a first area of one surface of the sheet bundle to be bound by the binding unit, and a second recessed portion in a second area on another surface of the sheet bundle, the first area and second area both corresponding to a position in the sheet bundle into which the binding member is driven.

2. The sheet processing apparatus according to claim 1, wherein the first recessed portion is formed to have a predetermined depth in the first area corresponding to the position in the sheet bundle into which the binding member is driven.

3. The sheet processing apparatus according to claim 2, wherein the predetermined depth is given a magnitude such that the binding member does not project from the first surface of the sheet bundle when the sheet bundle is bound by driving the binding member into the sheet bundle.

4. The sheet processing apparatus according to claim 1, wherein a span of the recessed portion in a width direction perpendicular to a sheet conveyance direction is longer than a span of the binding member in the width direction.

5. The sheet processing apparatus according to claim 1, wherein the recessed portion forming unit forms the second recessed portion recessed in a direction opposite the first recessed portion at a portion corresponding to a portion in which the binding member is driven from a side of a sheet on which the binding member is driven into the sheet bundle.

6. The sheet processing apparatus according to claim 5, wherein the second recessed portion has a depth provided such that the binding member does not project from the another surface of the sheet bundle when the sheet bundle is bound with the binding member.

7. The sheet processing apparatus according to claim 5, wherein a length of the second recessed portion in a width direction perpendicular to a sheet conveyance direction is longer than a length of the binding member in the width direction.

8. A sheet processing apparatus according to claim 5, wherein the recessed portion forming unit includes:

a first recessed portion forming unit configured to form the second recessed portion on a sheet forming a surface of a side from which the binding member is driven into the sheet bundle; and a second recessed portion forming unit configured to form the first recessed portion on a sheet forming a surface opposite the side from which the binding member is driven into the sheet bundle.

9. The sheet processing apparatus according to claim 8, wherein the first recessed portion forming unit and the second recessed portion forming unit are arranged in a shifted manner in a conveyance direction.

10. The sheet processing apparatus according to claim 8, wherein the first recessed portion forming unit and the second recessed portion forming unit are arranged in a shifted manner in a width direction.

11. An image forming apparatus comprising:

an image forming unit configured to form an image on a sheet; and a sheet processing apparatus configured to process the sheet on which the image is formed by the image forming apparatus, wherein the sheet processing apparatus includes:

a processing tray on which the sheets to be processed are sequentially conveyed and stacked;

a binding unit configured to bind a sheet bundle stacked on the processing tray by driving a binding member into the sheet bundle;

a sheet bundle stacking unit configured to sequentially stack the plurality of the sheet bundles each bound by the binding unit; and a recessed portion forming unit configured to form a first recessed portion in a first area of one surface of the sheet bundle to be bound by the binding unit, and a second recessed portion in a second area on another surface of the sheet bundle, the first area and second area both corresponding to a position in the sheet bundle into which the binding member is driven.

12. The sheet processing apparatus according to claim 1, wherein a length of the recessed portion is shorter than a length of the sheet bundle.

* * * * *